US008899349B2

(12) United States Patent
Rasmus et al.

(10) Patent No.: US 8,899,349 B2
(45) Date of Patent: Dec. 2, 2014

(54) METHODS FOR DETERMINING FORMATION STRENGTH OF A WELLBORE

(75) Inventors: John C. Rasmus, Richmond, TX (US); Vladimir Vaynshteyn, Sugar Land, TX (US); Roberto Suarez-Rivera, Salt Lake City, UT (US)

(73) Assignee: Schlumberger Technology Corporation, Sugar Land, TX (US)

( * ) Notice: Subject to any disclaimer, the term of this patent is extended or adjusted under 35 U.S.C. 154(b) by 249 days.

(21) Appl. No.: 13/554,649

(22) Filed: Jul. 20, 2012

(65) Prior Publication Data

US 2013/0186688 A1 Jul. 25, 2013

Related U.S. Application Data

(60) Provisional application No. 61/510,864, filed on Jul. 22, 2011.

(51) Int. Cl.
*E21B 47/06* (2012.01)

(52) U.S. Cl.
CPC ..... *E21B 47/06* (2013.01)
USPC ..... 175/50; 166/250.08; 73/152.22

(58) Field of Classification Search
USPC ..... 175/50, 48; 166/250.02, 250.07, 166/250.08, 250.1; 73/152.03, 152.22, 73/152.43, 152.46; 702/12, 13
See application file for complete search history.

(56) References Cited

U.S. PATENT DOCUMENTS

| | | | | |
|---|---|---|---|---|
| 4,793,413 | A * | 12/1988 | Singh et al. | 166/250.1 |
| 6,668,943 | B1 * | 12/2003 | Maus et al. | 175/5 |
| 6,823,950 | B2 * | 11/2004 | von Eberstein et al. | 175/5 |
| 6,904,365 | B2 * | 6/2005 | Bratton et al. | 702/9 |
| 7,054,751 | B2 * | 5/2006 | Craig | 702/13 |
| 7,774,140 | B2 * | 8/2010 | Craig | 702/11 |
| 2006/0155473 | A1 * | 7/2006 | Soliman et al. | 702/12 |
| 2007/0079652 | A1 * | 4/2007 | Craig | 73/152.22 |
| 2009/0101340 | A1 | 4/2009 | Jeffryes | |
| 2009/0255731 | A1 | 10/2009 | Backhaus et al. | |
| 2010/0206548 | A1 | 8/2010 | Pisio et al. | |

FOREIGN PATENT DOCUMENTS

EP 525944 A1 * 2/1993

OTHER PUBLICATIONS

Castillo, J.J.L., "Modified Fracture Pressure Decline Analysis Including Pressure-Dependent Leakoff", SPE 16417—Low Permeability Reservoirs Symposium, Denver, Colorado, May 18-19, 1987, 9 pages.

Nolte, Kenneth G. , "Determination of Fracture Parameters from Fracturing Pressure Decline", SPE 8341—SPE Annual Technical Conference and Exhibition, Las Vegas, Nevada, Sep. 23-26, 1979, 16 pages.

(Continued)

*Primary Examiner* — Kenneth L Thompson
(74) *Attorney, Agent, or Firm* — Mark D. Shelley, II; Kimberly Ballew

(57) ABSTRACT

A system and a method may determine formation strength of a well. The system and the method may use pressure measurements and temperature measurements to determine controlled fracture pressures before the uncontrolled fracture pressure is reached. The system and the method may use pressure measurements and temperature measurements to determine closure stresses while drilling and may use the closure stresses with core and log measurements to optimize a hydraulic stimulation program.

20 Claims, 16 Drawing Sheets

(56) References Cited

OTHER PUBLICATIONS

Rezmer-Cooper, et al., "Real-Time Formation Integrity Tests Using Downhole Data", SPE 59123—IADC/SPE Drilling Conference, New Orleans, Louisiana, Feb. 23-25, 2000, 12 pages.

Tollefsen, et al., "Unlocking the Secrets for Viable and Sustainable Shale Gas Development", SPE 139007—SPE Easton Regional Meeting, Morgantown, West Virginia, Oct. 12-14, 2010, 21 pages.

Van Oort, et al., "Improving Formation-Strength Tests and Their Interpretation", SPE 105193—SPE/IADC Drilling Conference, Amsterdam, The Netherlands, Feb. 20-22, 2007, 13 pages.

Earlougher, Jr., R.C. , "Chapter 7: Injection Well Testing", Advances in Well Test Analysis, SPE Monograph Series, vol. 5 of Henry Doherty Series, 1977, pp. 74-89.

Lee, John , "Chapter 3: Flow Tests", Well Testing, SPE Textbook Series: New York, vol. 1, 1982, pp. 50-62.

* cited by examiner

| OPERATIONAL IMPLEMENTATION OF INVENTION FOR PSP/CFP PRESSURES | | |
|---|---|---|
| | TELEMETRY SYSTEM | |
| | MUD PULSE | WDP/ACOUSTIC/EM |
| NO PACKER TOOL | NO PERMEABLE SANDS WITHIN DRILLED INTERVAL | NO PERMEABLE SANDS WITHIN DRILLED INTERVAL |
| | RIG PUMPS WITH SUFFICIENT FLOW FOR MODULATION NEEDED DURING TEST | RIG AND/ OR CEMENT PUMPS AND ONLY FLOW TO OVERCOME MUD COMPRESSIBILITY NEEDED DURING TEST |
| | DOWNHOLE PRESSURE DATA MUST BE TRANSMITTED DURING TEST | DOWNHOLE PRESSURE DATA MUST BE TRANSMITTED DURING TEST |
| | DATA MUST BE INTERPRETED DURING TEST | DATA MUST BE INTERPRETED DURING TEST |
| | ANNULAR BACKPRESSURE MUST BE APPLIED | ANNULAR BACKPRESSURE MUST BE APPLIED |
| | MAX APPLIED PRESSURE DICTATED BY THOSE DETERMINED AT CSG SHOE | MAX APPLIED PRESSURE DICTATED BY THOSE DETERMINED AT CSG SHOE |
| WITH PACKER TOOL | NO PERMEABLE SANDS WITHIN TESTED INTERVAL BETWEEN PACKERS | NO PERMEABLE SANDS WITHIN TESTED INTERVAL BETWEEN PACKERS |
| | RIG PUMPS WITH SUFFICIENT FLOW FOR MODULATION NEEDED DURING TEST | RIG AND/ OR CEMENT PUMPS AND ONLY FLOW TO OVERCOME MUD COMPRESSIBILITY NEEDED DURING TEST |
| | DOWNHOLE PRESSURE DATA MUST BE TRANSMITTED DURING TEST | DOWNHOLE PRESSURE DATA MUST BE TRANSMITTED DURING TEST |
| | DATA MUST BE INTERPRETED DURING TEST | DATA MUST BE INTERPRETED DURING TEST |
| | ANNULAR BACKPRESSURE NOT NEEDED | ANNULAR BACKPRESSURE NOT NEEDED |
| | MAX APPLIED PRESSURE NOT DICTATED BY THOSE DETERMINED AT CSG SHOE | MAX APPLIED PRESSURE NOT DICTATED BY THOSE DETERMINED AT CSG SHOE |
| | PACKER TOOL NEEDS DIVERTER VALVE | PACKER TOOL DOES NOT NEED DIVERTER VALVE |

*FIG. 17A*

| OPERATIONAL IMPLEMENTATION OF INVENTION FOR DETERMINING CLOSURE STRESS PRESSURES | | |
|---|---|---|
| | TELEMETRY SYSTEM | |
| | MUD PULSE | MUD PULSE |
| NO PACKER TOOL | NO PERMEABLE SANDS WITHIN DRILLED INTERVAL | NO PERMEABLE SANDS WITHIN DRILLED INTERVAL |
| | RIG PUMPS WITH SUFFICIENT FLOW FOR MODULATION NEEDED DURING TEST | RIG AND/OR CEMENT PUMPS AND ONLY FLOW TO OVERCOME MUD COMPRESSIBILITY NEEDED DURING TEST |
| | DOWNHOLE PRESSURE DATA DOES NOT NEED TO BE TRANSMITTED DURING TEST ONCE UFP DETERMINED | DOWNHOLE PRESSURE DATA DOES NOT NEED TO BE TRANSMITTED DURING TEST ONCE UFP DETERMINED |
| | DATA DOES NOT NEED TO BE INTERPRETED FOR CS DURING TEST ONCE UFP DETERMINED | DATA DOES NOT NEED TO BE INTERPRETED FOR CS DURING TEST ONCE UFP DETERMINED |
| | ANNULAR BACKPRESSURE MUST BE APPLIED | ANNULAR BACKPRESSURE MUST BE APPLIED |
| | MAX APPLIED PRESSURE DICTATED BY THOSE DETERMINED AT CSG SHOE | MAX APPLIED PRESSURE DICTATED BY THOSE DETERMINED AT CSG SHOE |
| WITH PACKER TOOL | NO PERMEABLE SANDS WITHIN TESTED INTERVAL BETWEEN PACKERS | NO PERMEABLE SANDS WITHIN TESTED INTERVAL BETWEEN PACKERS |
| | RIG PUMPS WITH SUFFICIENT FLOW FOR MODULATION NEEDED DURING TEST | RIG AND/OR CEMENT PUMPS AND ONLY FLOW TO OVERCOME MUD COMPRESSIBILITY NEEDED DURING TEST |
| | DOWNHOLE PRESSURE DATA DOES NOT NEED TO BE TRANSMITTED DURING TEST ONCE UFP DETERMINED | DOWNHOLE PRESSURE DATA DOES NOT NEED TO BE TRANSMITTED DURING TEST ONCE UFP DETERMINED |
| | DATA DOES NOT NEED TO BE INTERPRETED FOR CS DURING TEST ONCE UFP DETERMINED | DATA DOES NOT NEED TO BE INTERPRETED FOR CS DURING TEST ONCE UFP DETERMINED |
| | ANNULAR BACKPRESSURE NOT NEEDED | ANNULAR BACKPRESSURE NOT NEEDED |
| | MAX APPLIED PRESSURE NOT DICTATED BY THOSE DETERMINED AT CSG SHOE | MAX APPLIED PRESSURE NOT DICTATED BY THOSE DETERMINED AT CSG SHOE |
| | PACKER TOOL NEEDS DIVERTER VALVE | PACKER TOOL DOES NOT NEED DIVERTER VALVE |

*FIG. 17B*

METHODS FOR DETERMINING FORMATION STRENGTH OF A WELLBORE

CROSS REFERENCE TO RELATED APPLICATIONS

The present disclosure seeks priority to U.S. Provisional Patent Application 61/510,864, filed Jul. 22, 2011, the entirety of which is incorporated by reference.

FIELD OF THE INVENTION

The present disclosure generally relates to a system and a method for determining formation strength of a wellbore. More specifically, the present disclosure relates to a system and a method which use a measurement, such as a pressure measurement or a temperature measurement, to determine controlled fracture pressures before the uncontrolled fracture pressure is reached.

BACKGROUND INFORMATION

A typical system for drilling an oil or gas wellbore has a tubular drill pipe, known as a "drill string" and a drill bit located at the lower end of the drill string. During drilling, the drill bit is rotated to remove formation rock, and drilling fluid called "mud" is circulated through the drill string to remove thermal energy from the drill bit and remove debris generated by the drilling.

Typically, care is exercised during drilling to prevent downhole pressure exerted by the drilling mud from exceeding a fracture initiation pressure of the formation. More specifically, if the downhole pressure that is exerted by the drilling mud exceeds the fracture initiation pressure, the formation exposed to this pressure begins to physically break down and allow mud to flow into the fractured formation. Such a condition may result in damage to the formation in addition to creating a hazardous drilling environment. Therefore, after the lower bullnose end of the most recent installed casing string segment, known as the "casing shoe" is installed, a formation integrity test (FIT) or a "leak off test" (LOT) may be performed.

Mud pulse telemetry modulates the circulating mud flow to communicate information to the surface. Communication using mud pulse telemetry, however, provides infrequent measurements to the surface, and the measurements are only available when the mud pumps produce an adequate flow rate of the drilling mud. The flow rate of the drilling mud is insufficient to convey the measurements during some operations, such as a FIT, a LOT, or formation fluid flow check (FC) and a formation stress test (FST).

A FIT determines if the formation below the most recently installed casing section will be broken by drilling the next section with higher bottom hole pressure. A FIT also tests the integrity of the cementing of the most recently installed casing section. A LOT determines the fracture initiation pressure for the next segment of the wellbore to be drilled.

During a FIT, the pumping of the drilling mud continues until either a predetermined bottomhole pressure is reached or the loss of drilling mud into the formation is detected. More specifically, a FIT test will stop when one of two conditions has been met, the maximum mud weight expected for the next wellbore section has been achieved, or the pressure as a function of volume pumped curve indicates initiation of a fracture by exhibiting a change in slope. The point in the pressure as a function of volume pumped curve that indicates initiation of a fracture by exhibiting a change in slope is known as a fraction initiation point (FIP). The pressures and flow rates associated with the FIT/LOT typically are measured using sensors located at the surface of the wellbore. The results of the FIT/LOT indicate the maximum pressure or mud weight that may be applied to the next segment of the wellbore during drilling operations.

A FIT is less accurate than a LOT in determining the maximum pressure that can be safely applied to the formation at the casing shoe. However, a FIT is typically performed instead of a LOT for several reasons. First, the formation may be damaged by a LOT inducing a full far field hydraulic fracture. Second, the surface pressure that is monitored by a FIT or a LOT is not representative of the downhole pressure. Third, the time required for a LOT is greater than the time required for a FIT. Deep water wellbores have a high cost of rig operations; therefore, the time consumed by a LOT may be an especially important factor for deep water wellbores.

The FIT determination of the maximum pressure that may be applied to the next segment of the wellbore, namely the FIP, will always be below the maximum mud weight that may be safely applied to the next segment of the wellbore. The maximum mud weight to use while drilling the formation below the casing shoe is not determinable by current industry practices. Current industry practice is to determine the FIP and/or pressure at which the pump is stopped for the FIT, namely the pump stop pressure (PSP).

FIG. 1 generally illustrates a graph 10 of bottom hole pressure as a function of volume of drilling mud pump and then elapsed time in a LOT (SPE/IADC 105193, "Improving Formation Strength Tests and Their Interpretation," Eric Van Oort and Richard Cargo, 2007 SPE/IADC Drilling Conference). The FIP and the PSP are determined using a volume of drilling mud pumped as a function of time pumped plot, such as the plot depicted in the first test cycle of FIG. 1. When the curve deviates from a straight line representing fluid compressibility, the corresponding pressure is considered the FIP point.

A typical FIT ends at the PSP point or shortly thereafter. In contrast, an extended LOT has at least the first test cycle shown in FIG. 1. A FIT may conclude several minutes after pumping initiates, but an extended LOT may conclude several hours after pumping initiates. An extended LOT is primarily used when the fracture closure pressure (FCP) is of interest. FIG. 1 demonstrates that the FCP is determined by an extended LOT after the FIT would be concluded.

The FCP is less than the maximum mud weight that may be applied to the next segment of the wellbore as determined using the FIP or the uncontrolled fracture pressure (UFP) point. When the mud pressure reaches the FCP, the fracture will re-open. Because the mud pressure at which the fracture will re-open is below the maximum mud weight indicated by the FIP or the UFP, the LOT is disfavored and is performed disproportionately less relative to FIT tests.

Real-time downhole pressure measurements are lacking during a LOT, because mud pulse telemetry is unavailable during a LOT. Use of surface pressures compromises the accuracy of the determination of the formation integrity strength for multiple reasons.

First, the pressure at the casing show is estimated from the static surface mud weight measurement. If the properties of the drilling mud are not uniform or the drilling mud has suspended cuttings, this estimation is erroneous. The circulation time needed to achieve uniform drilling mud properties requires more time than the time which lapses during a FIT. Second, the compressibility, the frictional losses, and the actual temperature profile of the drilling mud affect the actual downhole pressure vs. time plot. Surface measurements cannot properly account for the compressibility, the frictional losses, and the actual temperature profile of the drilling mud. Third, the cementing unit pressure gauges used for measuring the surface pressures are less accurate than typical downhole gauges. For example, see SPE/IADC 59123, "Real-Time Formation Integrity tests Using Downhole Data," Rezmer-Cooper et al., 2000 IADC/SPE Drilling Conference. Fourth, the use of a linear pressure vs. volume of drilling mud pumped plot does not accurately determine when the fluid compressibility effects end.

FIG. 2 generally illustrates a graph 20 of pressure as a function of time in a LOT when both surface pressure and annular pressure while drilling were measured as a function of time. The graph has a first curve 21 which is a plot of the surface pressure while drilling as a function of time. The graph has a first curve 21 which is a plot of the surface pressure while drilling as a function of time. In addition, the graph has a second curve 22 which is a plot of the annular pressure while drilling as a function of time. FIG. 2 demonstrates that the surface pressure is not merely a simple offset from the downhole pressure but varies as the pressure increases for the reasons previously set forth herein. Comparisons of downhole and surface pressure data recorded during LOT's indicate that the previously identified reasons for inaccuracy in determination of formation integrity strength typically result in errors of 0.5 ppg to 1.0 ppg and occasionally result in errors as high as 2.5 ppg. Therefore, the use of surface pressure creates a large uncertainty in formation integrity strength calculations and compromises the design of the wellbore.

BRIEF DESCRIPTION OF THE DRAWINGS

FIGS. 17A and 17B are tables summarizing determination of the pump stop pressure, the controlled fracture pressure and the closure stress pressure according to one or more aspects of the present disclosure.

DETAILED DESCRIPTION

The present disclosure generally relates to a system and a method for determining formation strength of a well. More specifically, the present disclosure relates to a system and a method that may use pressure measurements and temperature measurements to determine controlled fracture pressures before the uncontrolled fracture pressure is reached. Moreover, the system and the method may use pressure measurements and temperature measurements to determine closure stresses while drilling and may use these closure stresses with core and log measurements to optimize a hydraulic stimulation program.

As described in more detail hereafter, downhole measurements may be used and interpreted with a unique method during the FIT/LOT procedure. For example, wired drill pipe (WDP) telemetry along with pressure measurements, such as annular pressure while drilling (APWD) measurements may be used during the FIT/LOT. As a result, the maximum acceptable pressure before the creation of an uncontrolled hydraulic fracture may be determined. Inclusion of a packer in a wellbore, such as proximate to or within the BHA, may facilitate periodic formation strength tests to provide a formation strength profile as a function of depth. The formation strength profile as a function of depth may be used to design an optimum program for drilling, casing/cementing and stimulation of the wellbore.

Use of the packer to isolate and test the formation below the packer elements may or may not be required. When the packer is not used in the FIT/LOT, the entire wellbore below the casing shoe may be tested to determine if any newly drilled formation is weaker then the segment drilled immediately below the casing shoe. A previously drilled formation which weakened with time may also be detected. When the packer is used during the FIT/LOT, only the formation below the packer is tested. As a result, a depth profile of formation strength properties may be determined. In an embodiment, a packer element may be present and occasionally not deployed during a test to identify whether a formation weakened with time somewhere within the drilled section.

A FIT/LOT may be performed as disclosed in U.S. Patent App. Pub. 2009/0101340 to Jeffryes et al. assigned to the assignee of the present disclosure and incorporated by reference in its entirety. For example, a FIT/LOT may be performed by a drilling system, such as, for example, the drilling system 70 generally illustrated in FIG. 3.

The drilling system 10 may use a wired drill pipe (WDP) infrastructure and/or may comprise a plurality of wired drill pipes, described herein, to communicate downhole measurements uphole during a FIT/LOT which may determine a fracture initiation pressure of a formation located near the bottom of a wellbore 71.

Figure 3:
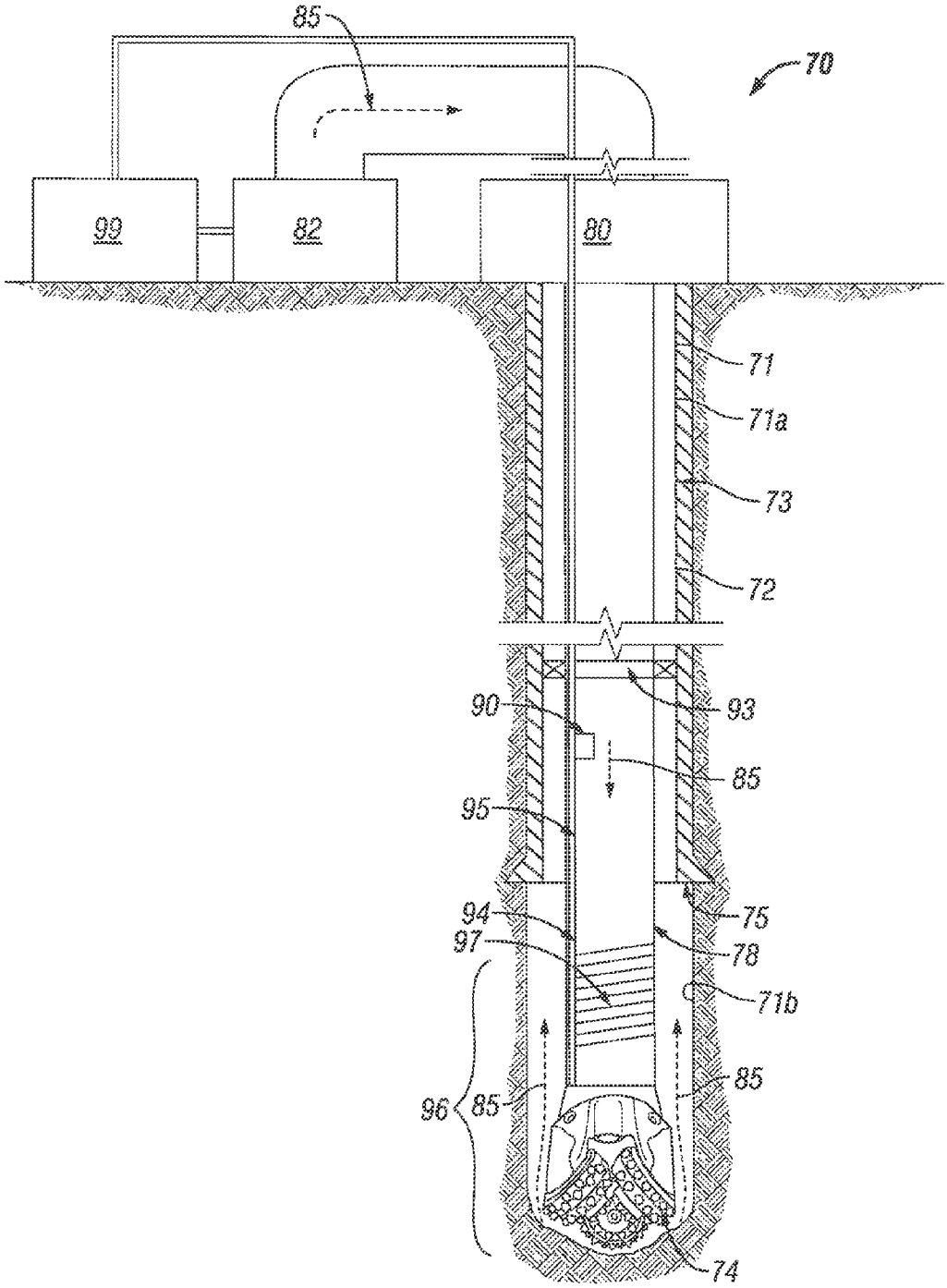
FIG. 3 is a schematic diagram of a drilling system according to one or more aspects of the present disclosure.

More specifically, FIG. 3 depicts a particular stage of a well during drilling and completion. In this stage, an upper element 71A of the wellbore 71 was formed through the operation of a drill string 72, in the upper wellbore segment 71*a* is lined with and supported by a casing string 73 cemented in the upper wellbore segment 71*a*. An initial portion of a lower, uncased segment 71*b* of the wellbore 71 was formed by the drill string 72. In particular, for the depicted stage, a drill bit 74 of the drill string 72 drilled through a casing show at a lower end 75 of the casing string 73 and formed the beginning of the lower, uncased wellbore segment 71*b*.

The FIT/LOT maybe performed before drilling of the lower, uncased wellbore segment 71*b* continues so that the drilling operation may be controlled based on a fracture initiation pressure for the lower, uncased wellbore segment 71*b*, namely the pressure at which the formation associated with the lower, uncased wellbore segment 71*b* begins to fracture. The FIT/LOT also may enable an assessment of the cementing of the most-recently installed casing string section.

To perform the FIT/LOT, communication through the well annulus that surrounds the drill string 72 is closed to enable the bottom hole pressure, namely the pressure in an uncased bottom hole region 78, to increase in response to an incoming flow introduced from the surface of the wellbore 71. As one example, a blowout preventer (BOP) 80 of the system 70 may be operated to close, or seal, the annulus of the wellbore 71 at the surface. After the annulus is closed, a surface pump 82 may be operated to establish a relatively constant and small volumetric rate mud flow 85 into the wellbore 71. The closed annulus prevents the pump system 82 from receiving return mud from the wellbore 71 during the FIT/LOT.

The mud flow may be introduced at the surface of the wellbore 71 into the central passageway of the drill string 72, rounded downhole through the central passageway of the drill string 72 to flow nozzles (not shown) that are located near the lower end of the drill string 72, and delivered through the nozzles to the bottom hole region 78 of the wellbore 71. In general, the pumping of the mud into the wellbore 71 may continue until one or more measured downhole parameters indicate that mud is lost into the formation or mud is lost outside of the casing string 73 due to an insufficient cementing job around the casing string 73. The latter cause typically is indicated early on in the FIT/LOT, as mud loss outside of the casing string 73 due to an insufficient cementing job occurs at a relatively low pressure.

In accordance with examples that are described herein, a FIT/LOT may be conducted based on real-time measurements that are acquired by downhole sensing devices and are communicated uphole to the surface of the well using a wired infrastructure of the drill string 72. For example, the drill string 72 may have a wired drill pipe (WDP) infrastructure 94 which may include (as a non-limiting example) wire segments 95 that may be partially embedded in the housing of the drill pipe 72 and may include one or more repeaters 90 along the length of the drill string 72 to boost the signals between wire segments 95. As an example, the drill string 72 may be formed from jointed tubing sections, and each section may have one or more wire segments 95, a repeater 90 and/or electrical contacts, such as inductive coupler, flex coupler or other device capable of transmitting data across the jointed tubing sections, on either and of the section to form electrical connections with the adjacent jointed tubing sections. The aspects described should not be deemed as limited to use of a drill string, other types of conveyance may be used, such as jointed drill pipe without wired infrastructure 94, jointed drill pipe used with wireline communication, and/or coiled tubing with a communication infrastructure, such as fiber optic, wireline or the WDP infrastructure 94.

The drill bit 74 may be part of a bottom hole assembly (BHA) 96 of the drill string 72. The bottom hole assembly 96 may also include various sensing devices to acquire measurements related to the drill string 72, the wellbore 71 and/or the formation about the wellbore 71. The BHA 96 may make measurements that are indicative of various downhole parameters, such as pressures, flow rates, resistivities, formation compression/shear velocities, and/or the like. A sensing tool 97 in the BHA may acquire various pressures and flow rates and/or may contain various sensing devices. The measurements that are acquired by the sensing tool 97 may be communicated uphole to the surface by the WDP infrastructure. As a result, an operator at the surface of the wellbore 71 may monitor the measured downhole parameters during the FIT/LOT using a processor 99.

The drill string 72 and/or the BHA 96 may have a packer 93, depicted as being radially expanded or "set" in FIG. 3, to isolate the bottom hole region of the formation being tested to limit the volume that receives the mud flow during the LOT. Thus, instead of introducing and pressurizing fluid in the entire well annulus, up to the BOP 40, the pressurized region only extends from the bottom of the wellbore 71 to the packer 93.

Interpretation of the results of the FIT/LOT may utilize the pressure and flow rates measured in the wellbore 71 during the wellbore fluid pressurization and subsequent flow into the tested formation. Surface measurements and/or downhole measurements may be utilized. The LOT procedure may be automatically or manually stopped before an uncontrolled hydraulic fracture is propagated into the tested formation as discussed in the following examples.

Figure 4:
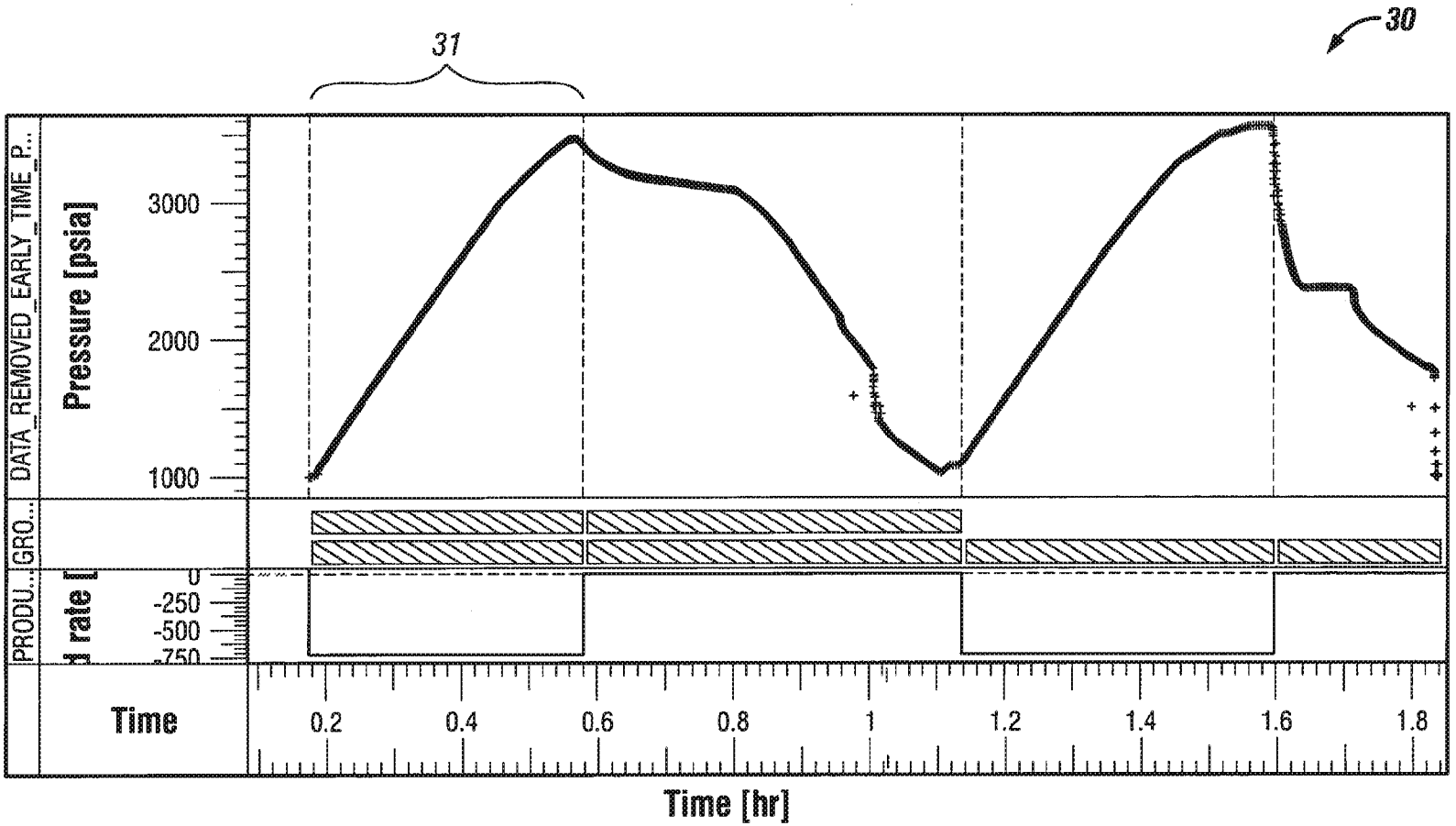
FIG. 4 generally illustrates a graph of data from a LOT which plots bottomhole pressure as a function of elapsed time for a formation of impermeable shale according to one or more aspects of the present disclosure.

In a first example, a LOT may test a formation of impermeable shale. FIG. 4 generally illustrates a graph 30 of measurements obtained in a LOT test for a formation of impermeable shale where water-based drilling mud was injected into the wellbore 71 from the surface, and the measured downhole wellbore pressure was allowed to increase. Surface cementing pumps measured the pressure and flow rate data. The pressure gauge resolution is approximately 2 psi. Although the resolution of a typical downhole pressure gauge may be orders of magnitude better, such a pressure gauge resolution is adequate as shown hereafter.

As shown in FIG. 4, in this example, the abrupt pressure decrease at 0.57 hours indicates the UFP, namely the pressure at which an uncontrolled hydraulic fracture is initiated. In this example, the pumps were stopped at 0.586 hours which is 54 seconds after the UFP was reached. In this example, the wellbore 71 remained closed until 0.81 hours to obtain the closure stress, and a surface valve was opened at 0.81 hours to release the remaining pressure.

Figure 5:
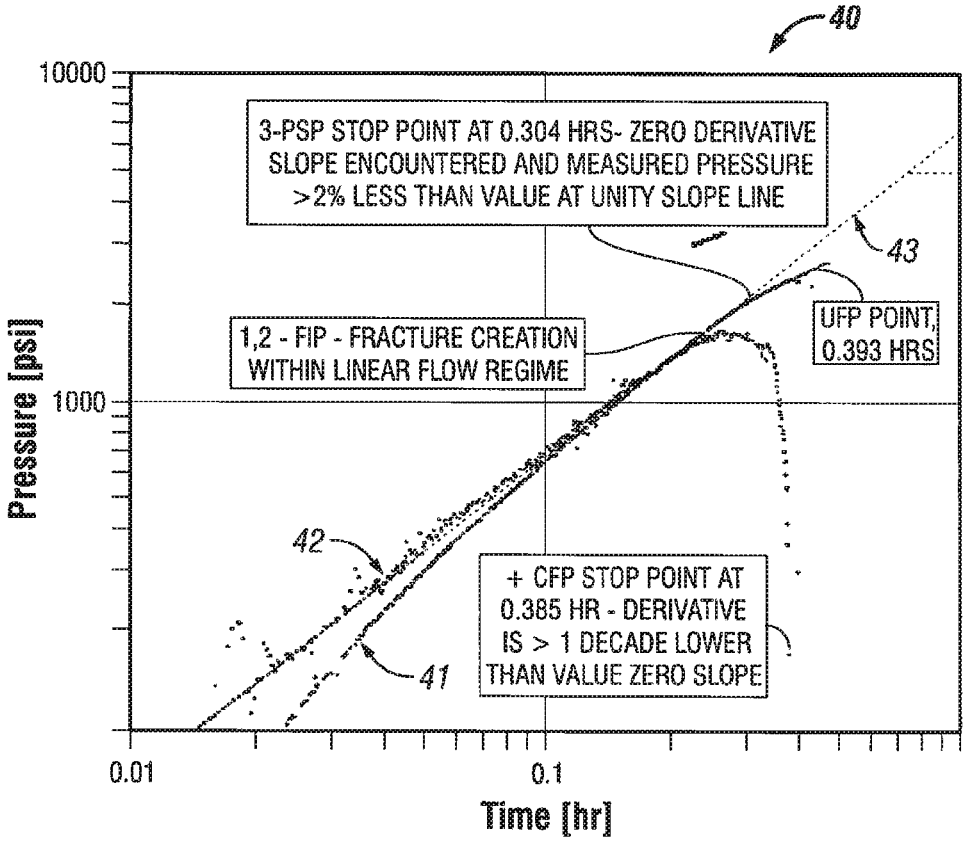
FIGS. 5 and 12 generally illustrate analysis of the data in FIG. 4 according to one or more aspects of the present disclosure.

The data labeled "Injection #3" in FIG. 4, namely the data 31, is plotted in the log-log plot 41 of delta pressure as a function of elapsed time in the graph 40 generally illustrated in FIG. 5. During a FIT/LOT, the data at early times is dominated by the wellbore storage coefficient which describes the mass accumulation of drilling mud in the wellbore 71. The mass accumulation of drilling mud in the wellbore 71 is a function of the fluid compressibility because the surface pumps compress the drilling mud already present in the wellbore 71 at the beginning of the FIT/LOT. During this time period, minimal flow or no flow of the drilling mud into the formation typically occurs and fracture initiation at the sandface does not occur. The wellbore storage coefficient may be computed the data at early times as follows:

$$C = \frac{Q * B}{24}\left(\frac{\partial(\Delta P)}{\partial(LN(\Delta t))}\right)$$

where

C=wellbore storage coefficient (bbl/psi)

Q=flowrate (bbl/d)

B=oil volume factor

ΔP=delta pressure

LN (Δt)=naturallog of delta time

The fluid compressibility is obtained by dividing the wellbore storage coefficient by the volume of drilling mud in the wellbore 71. FIG. 5 illustrates the determining of the wellbore storage coefficient for the FIT test in FIG. 4. The slope of the log-log plot 41 of delta pressure as a function of elapsed time in FIG. 5 is represented by the dashed line 43 and, by definition, is unity. The Y axis is the difference between measured pressure and the initial starting pressure. When the initial flow is zero and only one flow rate is utilized while pumping, the X axis becomes the actual measured elapsed time in hours. When multiple flow rates are used, the X axis becomes a pseudo function of time and is obtained for each data point as follows:

$$t = \frac{24 * Q_t}{q_t - q_{n-1}}$$

where t=time at measured pressure P,(hrs)

$Q_t$=total massflow (bbl)

$q_t$=flowrate in time period (bbl/d)

$q_{n-1}$=flowrate in previous time period (bbl/d)

Utilizing only one flow rate to inject is not required. When multiple flow rates are used, the elapsed time may not be read from the X axis. The derivative of the pressure with respect to the natural log of the pseudo time ("hereafter "the pressure derivative") is represented by the plot 42 in FIG. 5 and is obtained as follows:

$$d = \frac{\partial(\Delta P)}{\partial(LN(\Delta t))}$$

Due to the use of the natural log of the pseudo time, the pressure derivative is not simply the slope of the measured differential pressure in the log-log plot 41 of FIG. 5. The derivative of the pressure data with respect to the natural log of the pseudo time may be used to determine reservoir parameters as follows:

$$K * h = \frac{70.63 * Q * \mu * B}{m}$$

where

K=permeability,md h=height of zone

Q=bbl/d u=fluid viscosity

B=fluid formation volume factor m=derivative value

The slope of the pressure derivative with respect to the natural log of the pseudo time and the location in time of the slope changes may be used to identify the various flow regimes in the reservoir. The unity slope (early time) represents wellbore storage (WBS), the 0.25 slope represents bilinear flow (finite conductivity vertical fracture), the 0.5 slope represents linear flow (infinite conductivity vertical fracture), the −0.25 slope represents spherical flow (early time, partial penetration, permeable formation), and the 0.0 slope represents radial flow (late time, infinite acting, permeable formation). Changes in slope in late time usually represent boundary effects and may not be seen in the analysis of FIT/LOT data. Additionally, radial flow is not expected to occur in early time when pumping into an impermeable formation.

FIT/LOT analysis will generally encounter the WBS unity and linear 0.25-0.5 derivative slope regimes. Radial flow resulting in zero derivative slope is not expected except when the FIT/LOT is inadvertently performed into a permeable sand.

As the FIT/LOT progresses, initially the pressure increases according to the fluid compressibility. Then, after the FIP, the pressure increases more slowly as the wellbore drilling mud flows into the fractures induced in the near wellbore. The pressure then plateaus as these fractures grow in width and length and the drilling mud "leaks off" into the formation. Then, the pressure drops dramatically at the UFP as the fracture extends past the wellbore stress cage where only the far field closure stress and rock tensile strength must be overcome.

As the FIT/LOT progresses, the pressure derivative transitions from positive finite values during and after WBS to anomalously low values, then to zero values immediately before the UFP, and then eventually an undefined value at the UFP.

As the FIT/LOT progresses, the pressure derivative slope transitions from unity during WBS to 0.25-0.5 values during flow into the fracture. Then, the pressure derivative slope passes through zero slope during the growth of the fracture through the stress cage as the pressure derivative slope transitions to negative values. At the UFP, the pressure derivative slope becomes undefined values.

These pressure derivative slope values and transitions may be used to define the nature of the propagating fracture and limit the duration of the LOT when the pressure is not to exceed the UFP value. If the LOT is stopped when the 0.5 pressure derivative slope value is attained, the FIP has conclusively been reached and the creation of a UFP is highly unlikely. If the LOT is stopped at the transition from zero to a negative pressure derivative slope value and the pressure deviates from the unity slope line by a pre-determined amount, the UFP is not attained but is imminent. The absolute maximum pressure without creating a UFP is when the pressure derivative, not the pressure derivative slope, becomes less than a predetermined value on the pressure derivative plot 42.

The predetermined value may be empirically derived and may be the value of the pressure derivative that is one decade below the value attained at the end of the 0.5 slope and during the zero slope period. Hereafter, this predetermined value is referenced as the controlled fracture pressure (CFP) because this predetermined value represents the creation of a near wellbore hydraulic fracture that has not grown substantially into the formation. The near wellbore hydraulic fracture created at the CFP may be controlled and may be closed by reducing the wellbore pressure by immediately stopping the pumps.

The pressure derivative value and the pressure derivative slope value may define the criteria for a manual or automatic shutdown of the pumps for both the FIT and the LOT. The time axis in FIG. 5 is the measured elapsed time because the injection has only one flow rate. The pressure derivative plot 42 in the example depicted in FIG. 5 initially deviates from the unity slope line at 0.226 hrs after the initiation of pumping. In this example, a slope of 0.5 (linear fracture flow) continues until 0.265 hrs which is a duration of 2.3 minutes. In this example, the pressure varies from 1621 psi to 1815 psi during this 2.3 minutes. The pressure variance corresponds to the initiation and the propagation of the near wellbore fractures. In this example, the pressure deviates by approximately 50 psi from the unity slope line at 0.308 hours where the pressure is approximately 2100 psi. 0.308 hours is 2.58 minutes after the end of the linear slope regime. In this example, the UFP point occurs at 0.393 hours where the pressure is 2454 psi. 0.393 hours is 7.68 minutes after the end of the linear slope regime.

The FIT/LOT test may be automatically or manually stopped for determination of the FIP or PSP as described hereafter. To determine the PSP, the end of the linear flow regime as detected on the pressure derivative data will have been attained (a transition from 0.5 slope to zero slope) and the measured pressure will have deviated by approximately 1.4% from the absolute value (50 psi for this data) from the unity slope line. For the data shown in FIG. 5, the PSP occurs at 0.308 hours (2100 psi) which is 5.10 minutes before the creation of an uncontrolled hydraulic fracture at the UFP point and 479 psi to 285 psi above the pressure at which the near wellbore fracture was first initiated.

In this example, the value of the pressure derivative during the zero slope time is 1678. In this example, the time at which the pressure derivative becomes one decade less than this value is 0.385 hrs and may be used as the criteria to stop the test at the CFP. The CFP corresponds to 2435 psi which is 19 psi below the UFP and occurred 29 seconds before the uncontrolled fracture was created. The pressure of 2435 psi represents the maximum mud weight to be used to drill the subsequent open hole section; 2435 psi is 814 psi above the FIP point of 1621 psi. Accordingly, more pressure may be safely used based on determination of the CFP relative to the pressure which would be used based on the FIP.

Therefore, use of the CFP may enable rig personnel to maximize the pressure created during a FIT/LOT test without creating an uncontrolled hydraulic fracture. The mud weight in the subsequent open hole section may be increased to a higher value to enable the casing depth to be increased beyond the original well plan.

Figure 6:
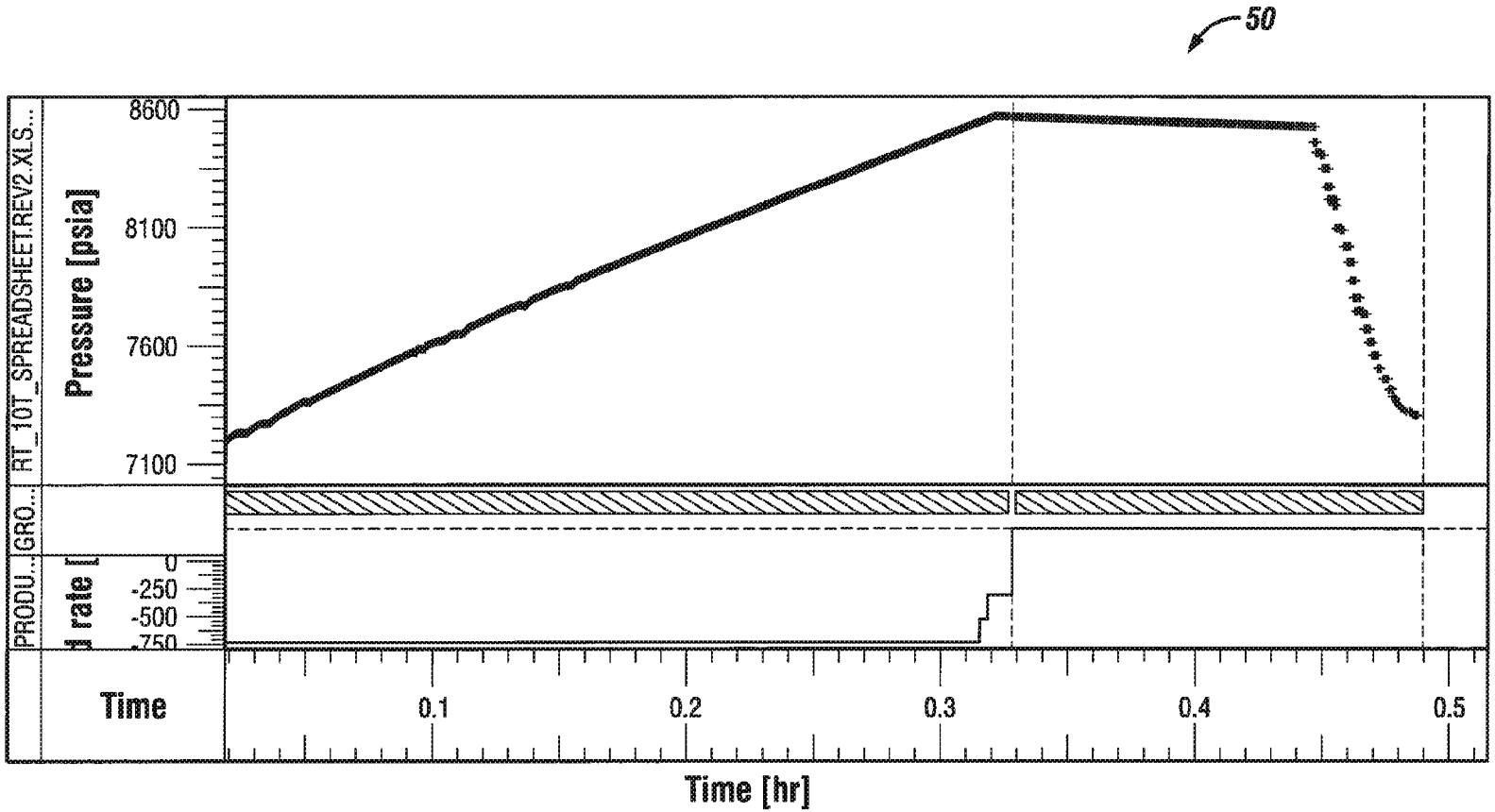
FIG. 6 generally illustrates a graph of data from a FIT which plots bottomhole pressure as a function of elapsed time for a formation of impermeable shale according to one or more aspects of the present disclosure.

In a second example, a FIT may test a formation of impermeable shale. FIG. 6 generally illustrates a graph 50 of measurements obtained in a FIT test where drilling fluid was injected into the wellbore 71 from the surface and the measured downhole wellbore pressure was allowed to increase. When the predetermined maximum pressure was attained, the injection was stopped and the pressure was allowed to stabilize. The abrupt "fall off" late in the test at 0.445 hours was due to opening a surface valve and is not considered in the interpretation of the measurements.

Figure 7:
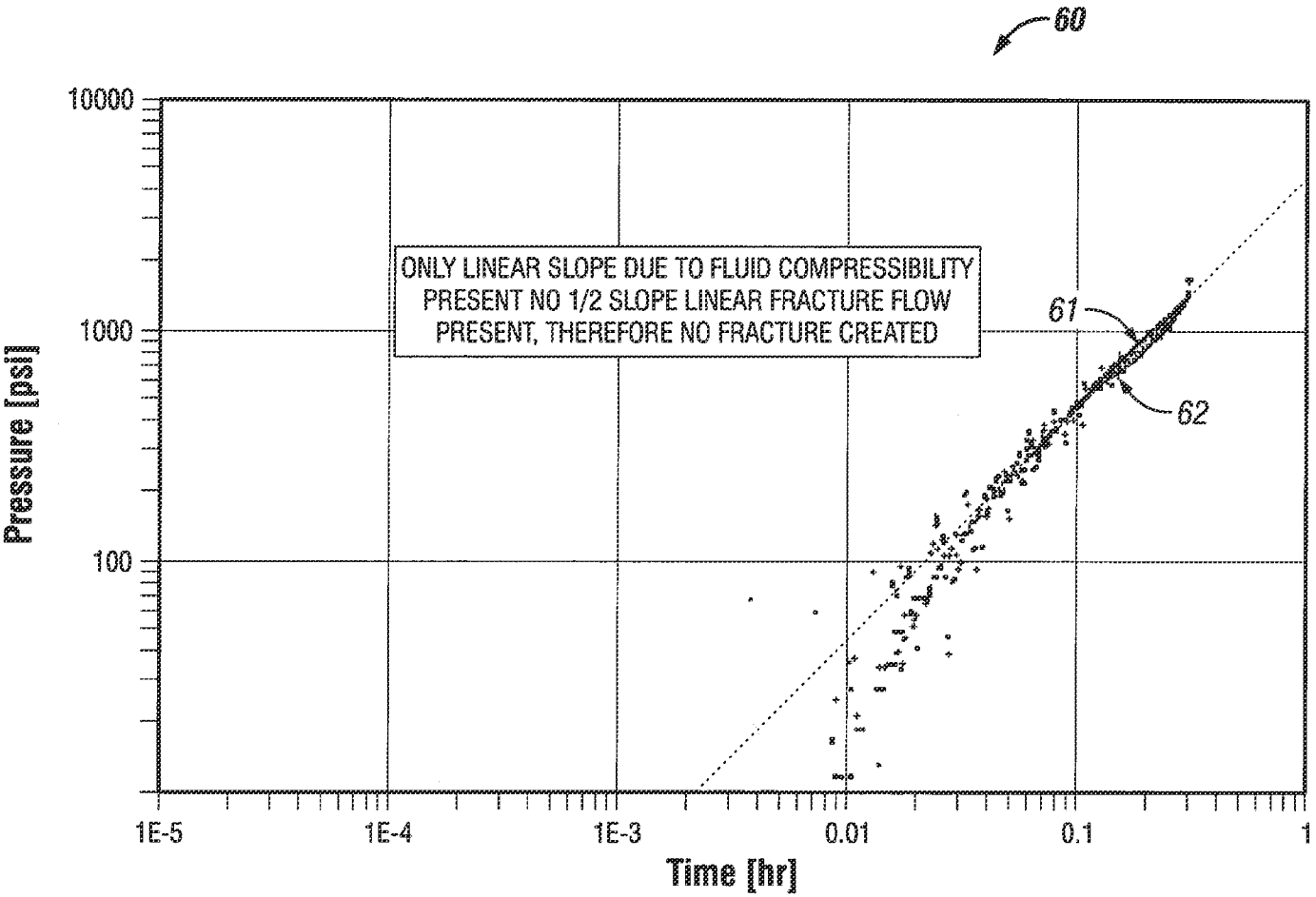
FIG. 7 generally illustrates analysis of the data in FIG. 5 according to one or more aspects of the present disclosure.

FIG. 7 generally illustrates a graph 60 having a log-log plot 61 of delta pressure as a function of elapsed time and a plot 62 of derivative pressure for the measurements in FIG. 6. Both the pressure derivative plot 62 and the log-log plot 61 of delta pressure as a function of elapsed time do not deviate from the wellbore storage unity slope. Therefore, the pressure derivative plot 62 and the log-log plot 61 of delta pressure as a function of elapsed time indicate that the FIP pressure was not attained. This is typical for a FIT where the test is terminated after a pre-determined downhole pressure is reached. The pre-determined downhole pressure limits the depth of the next open hole section and does not allow for extending this depth when the formation strength or pore pressure deviates from the expected values.

Determination of the PSP and/or the CFP for a specific pressure vs time record is not limited by the preceding examples. For the pressure vs. time records described in these examples, the number of steps, the order of steps and the operation performed in each step may be changed in various embodiments.

In summary, according to one or more aspects of the present disclosure, a FIT/LOT test may be stopped based on the PSP when all of the following criteria are met: 1) unity pressure derivative slope is detected, 2) 0.25 and/or 0.5 pressure derivative slope is detected, and 3) zero pressure derivative slope is detected for at least 30 seconds, and the measured delta pressure deviates from the unity slope line by a predetermined value. Pressure gauge accuracy is usually defined as a function of the absolute pressure value the pressure gauge is capable of reading. Typical pressure gauge accuracy is approximately 0.1% for strain gauges and approximately 0.025% for quartz gauges. In the example depicted in FIGS. 3 and 4, the measured pressure deviated by approximately 1.4% from the absolute value from the unity slope line. Therefore, the predetermined value of deviation was fourteen times larger than the pressure gauge accuracy, and the pressure readings reflect the formation response and not the pressure gauge accuracy.

According to one or more aspects of the present disclosure, a FIT/LOT test may be stopped based on the CFP when all of the following criteria are met: 1) unity pressure derivative slope is detected, 2) 0.25 and/or 0.5 pressure derivative slope is detected, 3) zero pressure derivative slope is detected for at least 30 seconds, and the measured delta pressure deviates from the unity slope line by a value 10-15 times greater than the pressure gauge accuracy, and 4) the pressure derivative value decreases by one decade from the value during the zero pressure derivative slope time period. The decrease of one decade ensures that the measured pressure response is no longer a function of wellbore storage or fluid compressibility effects and the uncontrolled propagation of a hydraulic fracture has not occurred.

When performing the test in real-time, the drilling process may be interrupted momentarily and the packer 93 may be set. The drilling mud in the drill string 72 and the annulus below the packer 93, or the last casing shoe if a packer 93 is not deployed, may be pressurized. The surface mud pumps, cementing pumps and/or a pump within a tool in the BHA 96 may be utilized to provide the pressure. Alternatively or additionally, a surface choke coupled with an annular preventer, such as in Managed Pressure Drilling (MPD) applications, may be utilized to provide the pressure. As known to one having ordinary skill in the art, MPD is a drilling technique in which the annular pressure profile is precisely controlled during steady-state well conditions and dynamic well conditions.

The derivative slope value may be monitored, and the FIT/LOT may be terminated when the four conditions previously set forth herein have been met. The use of MPD equipment may enable quick termination of the test relative to other means by opening the choke to relieve the annular backpressure instead of relying on stopping the pump. Opening the choke may enable a more precise control over the applied pressure during manual controlled operations or when using automatic feedback control systems relative to other means for stopping the FIT/LOT. Termination of the test at the termination point may be accomplished by visual observing the log-log plot of delta pressure as a function of elapsed time for the pressure measurements, such as the example shown in FIG. 5, and then manually stopping the pumps in response to the visual observation. Alternatively or in addition, termination of the test at the termination point may be accomplished by an electro-mechanical feedback loop controlling the rig, the cement pump controls, and/or the MPD equipment.

Accurate pressure data with frequent updates may be beneficial for calculating the pressure derivative. Therefore, strain gauges and/or quartz-dyne pressure gauges may be used to provide periodic measurements every two or three seconds.

In summary, the LOT embodiments disclosed herein leverage the use of low latency and high data frequency transmissions, such as MWD/LWD Annular Pressure While Drilling (APWD) data conveyed by WDP, to provide accurate downhole pressures at update rates that may enable the drilling engineer to quickly terminate the test using a combination of visual inspection of the data and identification of a maximum pressure that the formation will withstand before an uncontrolled hydraulic fracture is developed. Therefore, the LOT embodiments disclosed herein may proceed to higher pressures than the pressures determined from a standard FIT test. As a result, the LOT embodiments disclosed herein may enable deeper subsequent casing depths relative to a standard FIT test.

Figure 8:
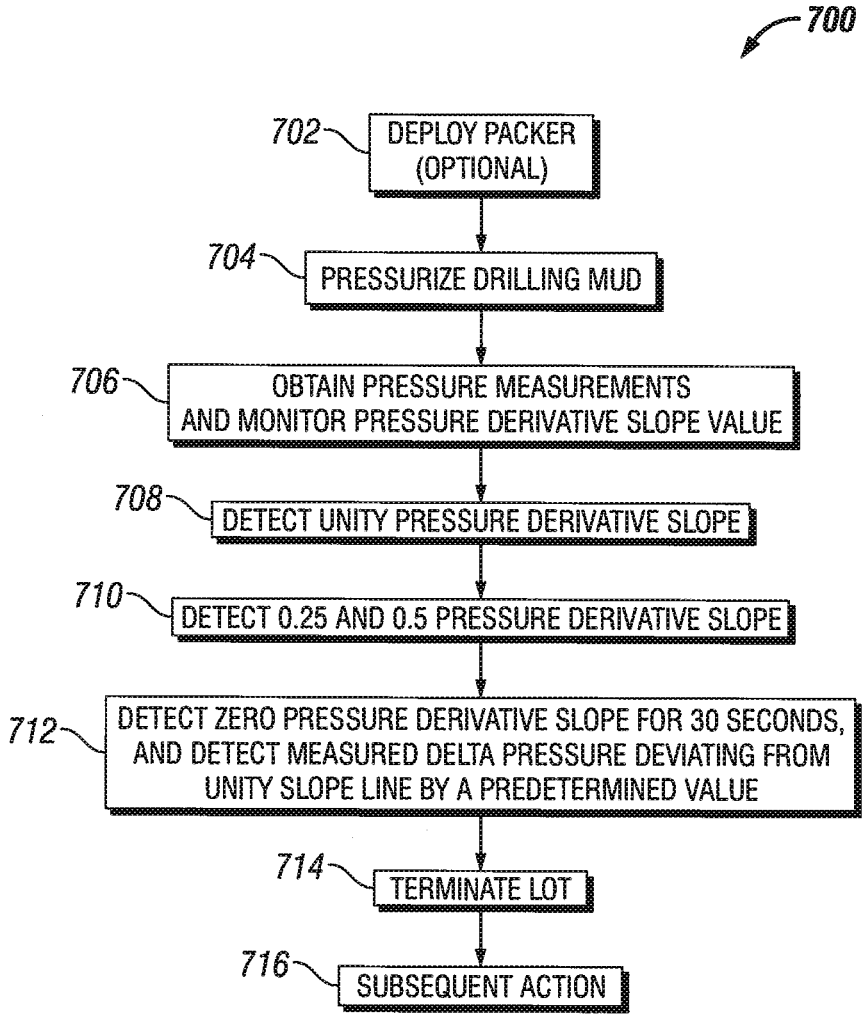
FIGS. 8-11, 13 and 14 generally illustrate methods according to one or more aspects of the present disclosure.

An example of a method 700 for performing a PSP-based LOT is generally illustrated in FIG. 8. In step 702, a downhole packer, such as a packer in the BHA 96 or the drill string 72, may be deployed. If a downhole packer is deployed during the LOT, only the formation below the packer is tested. Step 702 is optional; if a downhole packer is not used in the LOT, the entire wellbore below the casing shoe is tested to determine if any newly drilled formation is weaker than the segment drilled immediately below the casing shoe. A previously drilled formation which weakened with time may also be detected.

In step 704, the drilling mud in the drill string 72 and the annulus below the downhole packer, or the last casing shoe if a downhole packer is not deployed, may be pressurized. The surface mud pumps, the cementing pumps and/or a pump within a tool in the BHA 96 may be utilized to provide the pressure. Alternatively or additionally, a surface choke coupled with an annular preventer may be utilized to provide the pressure.

In step 706, pressure measurements may be obtained, and the pressure derivative slope value may be monitored. The pressure derivative slope value may be determined and/or may be monitored by the processor 99 which may be located downhole or at the surface. If the processor 99 is located at the surface, the processor 99 may be communicatively connected to downhole pressure sensors, such as pressure sensors in the sensing tool 97, by the WDP infrastructure 94. Alternatively or additionally, pressure sensors may be located at the surface. Computer readable medium, such as, for example, a compact disc, a DVD, a computer memory, a hard drive and/or the like, may enable the processor 99 to perform one or more steps of the method 700 and/or be used in the method 700.

In step 708, unity pressure derivative slope is detected. The processor 99 may detect the unity pressure derivative slope, and/or an operator viewing one or more graphs displayed by the processor 99 may make a visual observation of the unity pressure derivative slope. In step 710, 0.25 pressure derivative slope and/or 0.5 pressure derivative slope is detected. The processor 99 may detect the 0.25 pressure derivative slope and/or the 0.5 pressure derivative slope, and/or an operator viewing one or more graphs displayed by the processor 99 may make a visual observation of the 0.25 pressure derivative slope and/or the 0.5 pressure derivative slope.

In step 712, zero pressure derivative slope is detected for at least thirty seconds, and the measured delta pressure deviates from the unity slope line by a predetermined value. The processor 99 may determine that the zero pressure derivative slope is detected for at least 30 seconds, and the measured delta pressure deviates from the unity slope line by a predetermined value. Alternatively or additionally, an operator viewing one or more graphs displayed by the processor 99 may make a visual observation that the zero pressure derivative slope is detected for at least thirty seconds, and the measured delta pressure deviates from the unity slope line by a predetermined value.

In step 714, the LOT may be terminated. For example, the LOT may be terminated by stopping the rig mud pumps and/or the rig cement pumps. Alternatively or additionally, the LOT may be terminated by MPD equipment which opens the choke to relieve the annular backpressure instead of relying on stopping the pump. The LOT may be terminated manually based on user input from the operator and/or automatically by a feedback control system, such as an electromechanical feedback loop controlling the rig, the cement pump controls, and/or the MPD equipment. In step 716, subsequent action may be performed. For example, a subsequent open hole section may be drilled, and a pressure based on the PSP may be used to drill the subsequent open hole section.

Figure 9:
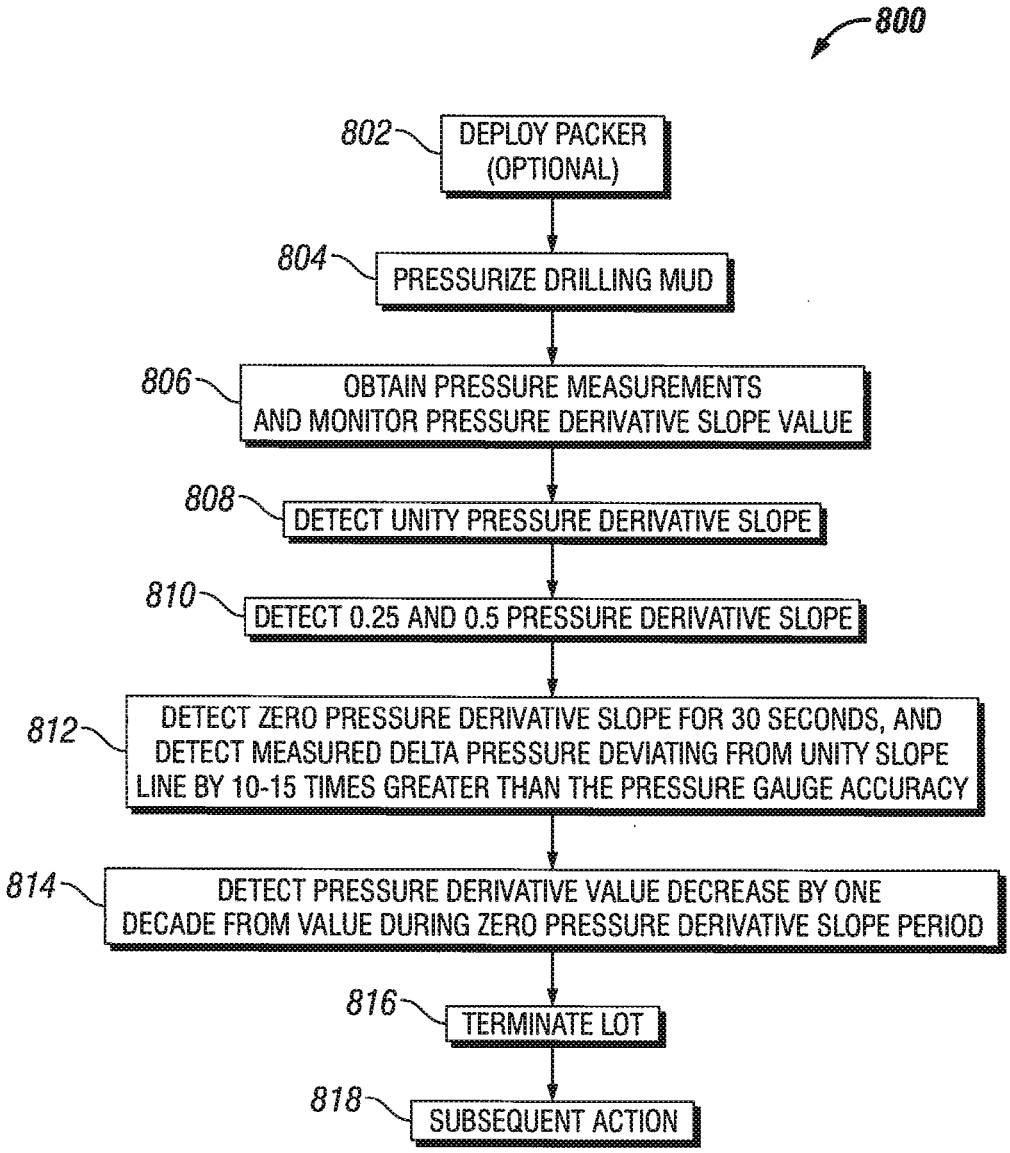

An example of a method 800 for performing a CFP-based LOT is generally illustrated in FIG. 9. In step 802, a downhole packer, such as a packer in the BHA 96 or the drill string 72, may be deployed. If a packer is deployed during the LOT, only the formation below the packer is tested. Step 802 is optional; if a packer is not used in the LOT, the entire wellbore below the casing shoe is tested to determine if any newly drilled formation is weaker than the segment drilled immediately below the casing shoe. A previously drilled formation which weakened with time may also be detected.

In step 804, the drilling mud in the drill string 72 and the annulus below the packer, or the last casing shoe if a packer is not deployed, may be pressurized. The surface mud pumps, the cementing pumps and/or a pump within a tool in the BHA 96 may be utilized to provide the pressure. Alternatively or additionally, a surface choke coupled with an annular preventer may be utilized to provide the pressure.

In step 806, pressure measurements may be obtained, and the derivative pressure slope value may be monitored. The derivative pressure slope value may be determined and/or may be monitored by a processor 99 which may be located downhole or at the surface. If the processor 99 is located at the surface, the processor 99 may be communicatively connected to downhole pressure sensors, such as pressure sensors in the sensing tool 97, by the WDP infrastructure 94. Alternatively or additionally, pressure sensors may be located at the surface. Computer readable medium, such as, for example, a compact disc, a DVD, a computer memory, a hard drive and/or the like, may enable the processor 99 to perform one or more steps of the method 800 and/or be used in the method 800.

In step 808, unity pressure derivative slope is detected. The processor 99 may detect the unity pressure derivative slope, and/or an operator viewing one or more graphs displayed by the processor 99 may make a visual observation of the unity pressure derivative slope. In step 810, 0.25 pressure derivative slope and/or 0.5 pressure derivative slope is detected. The processor 99 may detect the 0.25 pressure derivative slope and/or the 0.5 pressure derivative slope, and/or an operator viewing one or more graphs displayed by the processor 99 may make a visual observation of the 0.25 pressure derivative slope and/or the 0.5 pressure derivative slope.

In step 812, zero pressure derivative slope is detected for at least thirty seconds, and the measured delta pressure deviates from the unity slope line by a value 10-15 times greater than the pressure gauge accuracy. The processor 99 may determine that the zero pressure derivative slope is detected for at least 30 seconds, and the measured delta pressure deviates from the unity slope line by a value 10-15 times greater than the pressure gauge accuracy. Alternatively or additionally, an operator viewing one or more graphs displayed by the processor 99 may make a visual observation that the zero pressure derivative slope is detected for at least 30 seconds, and the measured delta pressure deviates from the unity slope line by a value 10-15 times greater than the pressure gauge accuracy.

In step 814, the pressure derivative value decreases by one decade from the value during the zero pressure derivative slope time period. As previously set forth, the CFP is the value of the pressure derivative that is one decade below the value attained at the end of the 0.5 pressure derivative slope and during the zero slope period. The processor 99 may detect that the CFP is reached, and/or an operator viewing one or more graphs displayed by the processor 99 may make a visual observation that the CFP is reached.

In step 816, the LOT may be terminated. For example, the LOT may be terminated by stopping the rig mud pumps and/or the rig cement pumps. Alternatively or additionally, the LOT may be terminated by MPD equipment which opens the choke to relieve the annular backpressure instead of relying on stopping the pump. The LOT may be terminated manually based on user input from the operator and/or automatically by a feedback control system, such as an electromechanical feedback loop controlling the rig, the cement pump controls, and/or the MPD equipment. In step 818, subsequent action may be performed. For example, a subsequent open hole section may be drilled, and a pressure based on the CFP may be used to drill the subsequent open hole section.

The determination of the PSP and/or the CFP as previously set forth herein determines these values for a specific instance of the pressure vs time record. The PSP and/or the CFP may be determined for a series of tests as described in the examples that follow.

Figure 10:
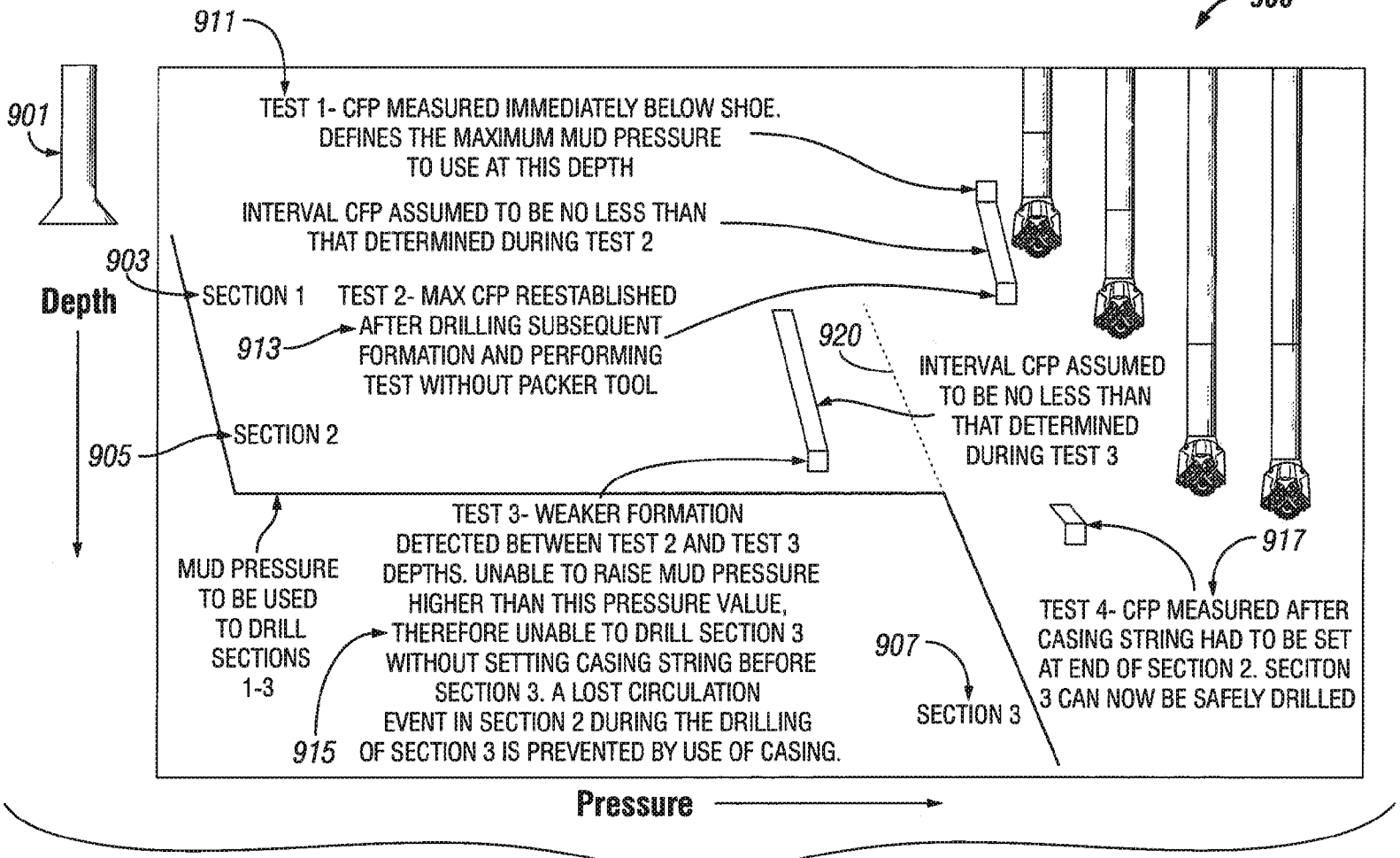

In a first example, the PSP and/or the CFP pressures may be applied without a downhole packer and without a packer in the BHA 96 or the drill string 72. FIG. 10 generally illustrates a method 900 of using the PSP and/or the CFP if a downhole packer is not present in the BHA 96 or drill string 72. If packers are not present in the BHA 96 or the drill string 72 as drilling progresses below the last casing shoe 901, isolation of a specific interval to pressurize may be prevented. As a result, the entire open hole section below the last casing shoe 901 may be tested. The PSP and/or the CFP determined at the last casing shoe 901 may impose an upper limit for subsequent tests. Therefore, the subsequent tests may only determine if any of the newly drilled formations are weaker than the formation drilled immediately below the last casing shoe 901. The subsequent tests may also determine if a previously drilled and tested interval weakened with time. FIG. 10 generally illustrates the tests implemented in this scenario which may test a first section 903, a second section 905 and/or a third section 907 of the wellbore 71.

In step 911, a first FIT/LOT may be performed in the section of newly drilled formation formed after the casing shoe 701 has been set. In step 913, a second FIT/LOT may be performed while the drill bit 74 is adjacent to the bottom of the wellbore 71 but not in contact with the bottom of the wellbore 71, such as, for example, when a connection has been made. The entire open hole section may be subjected to the applied pressures of the second FIT/LOT.

The drill bit 74, the BHA 96 and the pressure sensors, such as pressure sensors in the sensing tool 97, may be located at any depth because the entire open hole section is open. However, positioning the pressure sensors in the BHA 96 proximate to the bottom of the wellbore 71 may be advantageous. The maximum pressures will be located at the bottom of the wellbore 71. Therefore, positioning the pressure sensors proximate to the bottom of the wellbore 71 may prevent estimating the pressures at the bottom of the wellbore 71 using the mud gradient and pressure measurements obtained uphole from the bottom of the wellbore 71.

Pressures may be applied to the open hole section by closing the annular blowout preventer (BOP) and/or by using the rig mud pumps to increase the pressure in the system. Alternatively or additionally, the pressures may be applied using the rig cement pumps and/or using injection by the MPD (Panaged Pressure Drilling) equipment. The release of the annular pressure after determination of the stop point of the test, namely the PSP or the CFP, may be accomplished by stopping the pumps or by releasing the annular pressure at the annular choke using the MPD equipment independent of the pumps. A combination of techniques may be utilized; for example, the rig mud pumps and/or the rig cement pumps may be stopped and the choke system of the MPD equipment may release the annular pressure without actively pumping into the annulus with the MPD equipment.

Pressure measurements obtained at multiple locations may be monitored and may be analyzed. For example, APWD (Annular Pressure While Drilling) sensors in the BHA 96 may obtain pressure measurements; ASM (Along String Measurements) sensors may obtain pressures measurements and/or temperature measurements for the drill string 72; and/or surface sensors may obtain surface standpipe pressures and/or surface annular pressures. The pressure at the casing shoe 901 may be increased to values less than or equal to the PSP and/or the CFP.

The pressures between the casing shoe 901 and the bottom of the wellbore 71 may be a function of the density of the drilling mud in the wellbore 71. As illustrated in FIG. 10, the pressures between the casing shoe 901 and the bottom of the wellbore 71 exceed the pressure at the casing shoe 901. More specifically, the slope of the pressures during the FIT/LOT is the same as the slope of the mud pressure in the wellbore 71. As shown in FIG. 10, the entire section of the wellbore 71 between the depth of the first FIT/LOT and the depth of the second FIT/LOT will withstand these pressures.

In the example illustrated in FIG. 10, a third FIT/LOT may be performed at step 915. In this example, the third FIT/LOT may detect a section of the wellbore 71 located between the depth of the second FIT/LOT and the depth of the third FIT/LOT that exhibits a lower PSP/CFP relative to the PSP/CFP at the casing shoe 901. The PSP/CFP exceeds the drilling mud pressure applied. Therefore, this section exhibits a lower PSP/CFP relative to the PSP/CFP at the casing shoe 901, and a lost circulation event will not occur in this section. However, based on the drilling mud pressure planned for the third section 907 of the wellbore 71, the drilling mud pressure represented by the dashed line 920 at the depth of the second FIT/LOT exceeds the PSP and the CFP pressure for the third section 907 of the wellbore 71 as determined from the third FIT/LOT. Therefore, a casing string may be set immediately above the third section 907 of the wellbore 71 if the drilling mud pressure planned for the third section 907 will be attained.

The formation pore pressure and wellbore stability may be monitored in real-time to determine if the planned drilling mud pressure for the third section 907 is necessary. If the necessary drilling mud pressure may be maintained below the PSP and the CFP for the third section 907 of the wellbore 71 as determined from the third FIT/LOT, the third section 907 may be drilled without a casing string. If the necessary drilling mud pressure may not be maintained below the PSP and the CFP for the third section 907 of the wellbore 71 as determined from the third FIT/LOT, the PSP and/or the CFP determined from the third FIT/LOT may prevent a lost circulation event in the second section 905 while the third section 907 is drilled.

At step 917, a fourth FIT/LOT may be performed. The fourth FIT/LOT may determine the CFP after the casing string is set immediately above the third section 907. After the fourth FIT/LOT determines the CFP, the third section 907 may be drilled.

If a permeable sand is present between the drill bit 74 and the casing shoe 901, increasing the pressure to the PSP and/or to the CFP may result in the loss of drilling mud into the formation because the formation pore pressure will be exceeded. The presence of permeable formations may require the use of one or more packers in the drill string 72 and/or the BHA 96 to isolate the tested impermeable formation as described in the following example.

Figure 11:
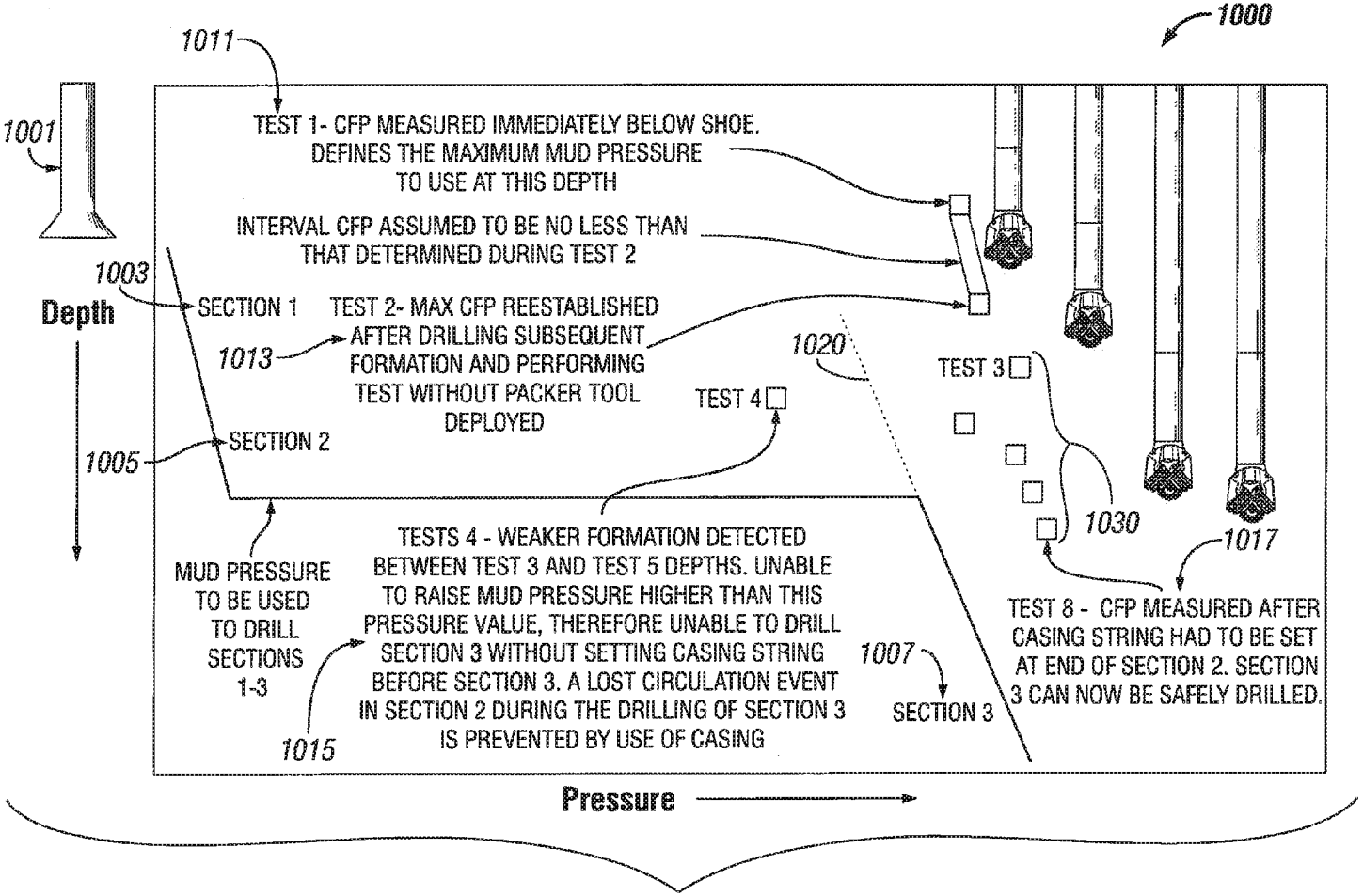

In a second example, the PSP and/or the CFP pressures may be applied with a packer in the BHA 96 and/or the drill string 72. FIG. 11 generally illustrates a method 1000 of using the PSP and/or the CFP if a packer is present in the BHA 96 and/or the drill string 72. The method 1000 may test a first section 1003, a second section 1005 and/or a third section 1007 of the wellbore 71.

If the packer is employed during the FIT/LOT, the packer may ensure that only the formation below the downhole packer is tested. As a result, a higher resolution depth profile of formation strength properties may be determined relative to tests performed without a packer. The packer may be located in the BHA 96 and occasionally not deployed during a FIT/LOT. Performing a FIT/LOT without deploying the packer may enable identification of a formation within the drilled section of the wellbore 71 that weakened. In step 1011, a first FIT/LOT may be performed. In step 1013, a second FIT/LOT may be performed, and the second FIT/LOT is an example of a FIT/LOT performed without deploying the packer.

A third FIT/LOT may be performed after the second FIT/LOT, and the third FIT/LOT may be performed with the packer deployed. The packer may provide the functionality of an annular BOP or a surface annular choke in a MPD system at a downhole location. If one packer is used, deployment of the packer isolates the section of the wellbore 71 between the drill bit 74 and the packer from the sections of the wellbore 71 above the packer. If two packers are used, deployment of the two packers isolates the section of wellbore 71 between the two packers from the sections of the wellbore 71 above the top packer and below the bottom packer.

In FIG. 11, the tested sections of the wellbore 71 are represented by the squares 1030. As a result of the isolation provided by the one or more packers, the pressure may be increased above the PSP and the CSP determined in the second FIT/LOT without causing a lost circulation event in the first section 1003 or the second section 1005. The analysis of pressure measurements for determination of the CFP may be performed during the third FIT/LOT, and the CFP may be assigned to the section of the wellbore 71 exposed during the third FIT/LOT.

In step 1015, the fourth FIT/LOT may detect a section of the wellbore 71 located between the depth of the third FIT/LOT and the depth of the fifth FIT/LOT that exhibits a lower PSP/CFP relative to the PSP/CFP at the casing shoe 1001. The PSP/CFP exceeds the drilling mud pressure applied. Therefore, this section that exhibits a lower PSP/CFP relative to the PSP/CFP at the casing shoe 1001, and a lost circulation event will not occur in this section. However, based on the drilling mud pressure planned for the third section 1007 of the wellbore 71, the drilling mud pressure represented by the dashed line 1020 at the depth of the third FIT/LOT exceeds the PSP and the CFP pressure for the third section 1007 of the wellbore 71 as determined from the fourth FIT/LOT in this example. Therefore, a casing string may be set immediately above the third section 1007 of the wellbore 71 if the drilling mud pressure planned for the third section 1007 will be attained.

The formation pore pressure and wellbore stability may be monitored in real-time to determine if the planned drilling mud pressure for the third section 1007 is necessary. If the necessary drilling mud pressure may be maintained below the PSP and the CFP for the third section 1007 of the wellbore 71 as determined from the third FIT/LOT, the third section 1007 may be drilled without a casing string. If the necessary drilling mud pressure may not be maintained below the PSP and the CFP for the third section 1007 of the wellbore 71 as determined from the fourth FIT/LOT, the PSP and/or the CFP determined from the fourth FIT/LOT may prevent a lost circulation event in the second section 1005 while the third section 1007 is drilled.

The tested formation may be strengthened with mud additives and/or pumping material directed into the tested formation if the tested formation is permeable. If the tested formation is strengthened, the third section 1007 may be drilled without an additional casing string. Therefore, remedial actions may be performed in response to determining the location of a weaker formation.

At step 1017, an eighth FIT/LOT may be performed. The eighth FIT/LOT may determine the CFP after the casing string is set above the third section 1007. After the eighth FIT/LOT determines the CFP, the third section 1007 may be drilled.

In a third example, a packer may be deployed downhole to control an influx of drilling mud while drilling. The packer may be located in the drill string 72 and may be deployed if an influx of drilling mud is detected from a recently drilled formation. As a result of deployment, the drilling mud of the influx may be isolated in the annulus to prevent the drilling mud from traveling upward through the annulus. The pressure measurements below the packer may indicate the formation pressure and/or a drilling mud pressure necessary to stop the influx. By including a circulating sub in the packer, the drilling mud may circulated within the annulus above the packer. If sufficient pressure exists in the annulus above the packer, the packer may be released for resumption of normal drilling operations.

Determination of the PSP and/or the CFP for a series of tests is not limited by the preceding examples. For each series of tests described in these examples, the number of tests, the order of tests and the type of tests implemented may be changed in various embodiments.

Figure 1:
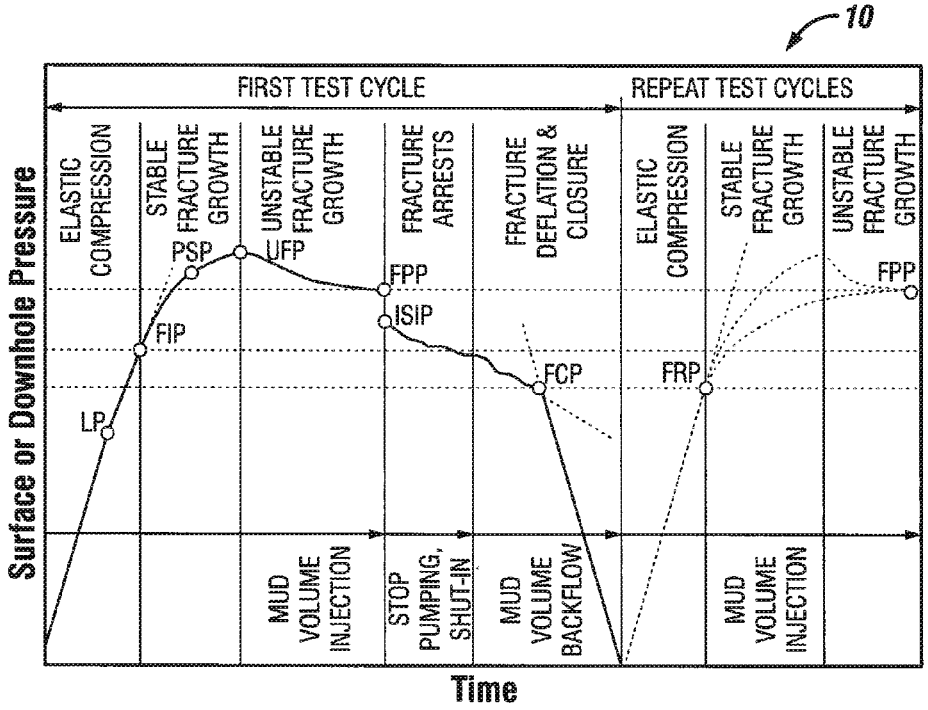
FIG. 1 generally illustrates a graph of data from a LOT which plots bottomhole pressure vs. volume of drilling mud pumped and then elapsed time.
Figure 2:
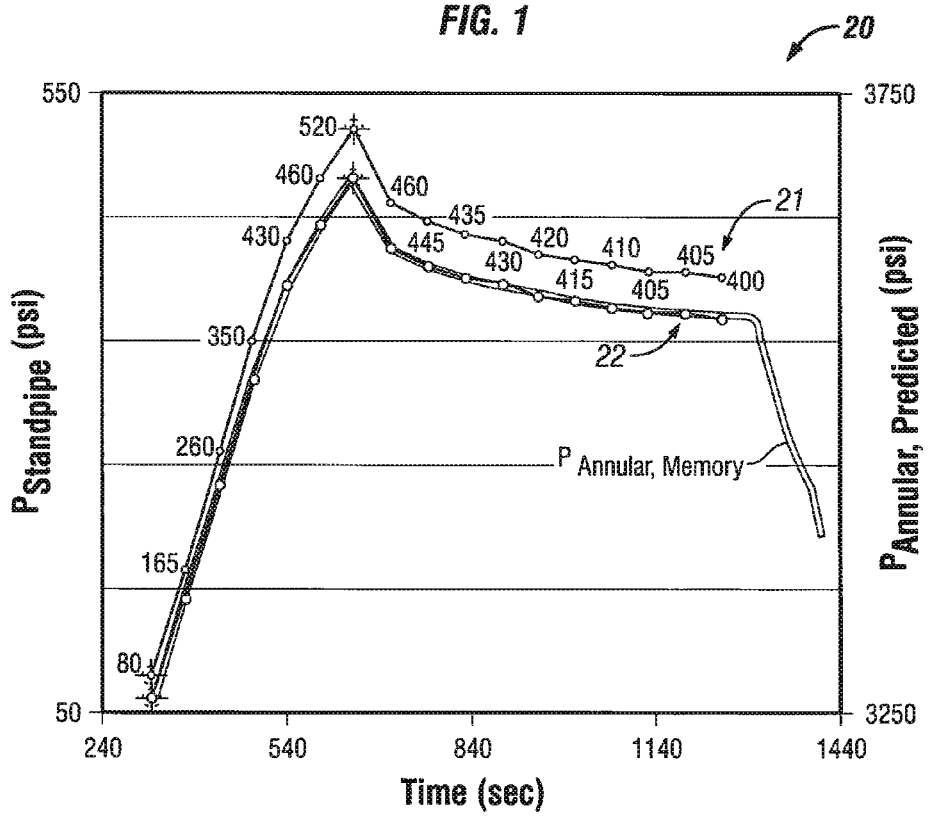
FIG. 2 generally illustrates a graph of pressure as a function of time in a LOT where both surface pressure and annular pressure while drilling are measured as a function of time.

Determination of the closure stress after creation of a fracture may be performed. The minimum far-field formation stress may be determined in situ by performing a LOT such that the UFP point is attained and drilling mud is being injected into the formation through the fracture created by the test. Then, injection may be stopped and the pressure may be allowed to slowly dissipate over time. The pressure at which the fracture closes is typically approximately equivalent to the closure stress, such as, for example, the FCP in FIG. 1.

The closure stress may be a function of the near wellbore stress concentration or the far field earth stresses depending on the radial extent of the fracture. When the closure stress is a function of the far field closure stress, the closure stress may be used with other nearby formation closure stress values to determine the geometry of induced hydraulic fractures. The measured pressures verses time for an extended LOT response may be analyzed using techniques previously set forth herein to determine these closure stresses. For example, the log-log plot of delta pressure as a function of elapsed time for the pressure measurements of a FIT/LOT may be used to determine the closure stress as explained in more detail hereafter.

The drilled formation is not always weakest at the casing shoe. Multiple measured formation strength tests may be used to calibrate the log measurements. Formations located directly above or directly below salt layers may be weaker than the formations located a greater distance from the salt layers. Faulting and tectonics may create abnormal and unexpected stress states in the subsurface. The closure stress profile at regular depth intervals may be used to predict where an induced hydraulic fracture will propagate and/or in what direction the fracture will propagate.

The closure stresses at depths below the casing shoe may be measured with minimal or no interruption of the drilling process. To obtain a formation closure stress profile with depth during drilling, a packer sub in the BHA 96 may measure closure stresses while a real-time WDP-based LOT is performed as previously set forth herein, such as, for example, by increasing the pressure to create the UFP as previously set forth herein.

For example, when performing the real-time WDP-based LOT, the drilling process may be interrupted momentarily, the packer may be deployed, and the drilling mud in the drill string and the annulus below the packer may be pressurized. The surface mud pumps, the cementing pumps, a pump within a tool in the BHA 96, and/or a surface choke coupled with an annular preventer, such as in Managed Pressure Drilling (MPD) applications, may be utilized to provide the pressure. A tool in the BHA 96 and/or a surface choke coupled with an annular preventer may more precisely increase the pressure relative to the other means for terminating the test due to lower volume capacities. The derivative slope value may be monitored, and the test may be terminated when the four criteria previously set forth are fulfilled.

The closure stress determinations may also be performed while removing the drill string 72 from the wellbore 71 after drilling. The location of the tests may be determined in several ways. The measurements may be made at as many depths as practical with respect to rig time. Further, the measurements may be made at depths which capture the stress contrasts of various layers because the hydraulic fracture geometry is based on the stress contrasts of the various layers.

Selection of the layers to test may be performed using measurements that enable characterization of the rock types along the lateral, such as LWD measurements, wireline through the drill bit measurements, drill cutting analysis, Residual Gas Saturation (SGR) measurements on the drill bit, real-time geochemical mud composition, real-time gas isotope analysis, and the like. The layer properties may be correlated to previous measurements and closure stress profiles in offset wells using heterogenous rock analysis (HRA) and/or a similar facies/rock class grouping technique. Alternatively or additionally, the layer properties may be determined by measuring the significant layer changes in real-time using data for the current wellbore. The analysis of predicted closure stresses by layer from the offset wellbores compared to the measured closure stresses in the current wellbore 71 may be used to quantify the lateral variability of the individual layers to predict the geometrical extent of the hydraulic fracture and/or the need for and the placement of additional wellbores.

When the FIP and the FCP are determined, the open hole interval between the drill bit 74 and the packer has been tested. Subsequent LWD azimuthal measurements within the BHA 96, such as resistivity images and/or density images, may be used to verify the depth of the layer containing the fracture and the azimuthal direction and orientation from vertical of the fracture. The FIP, the FCP and the geometry of the induced fracture may provide the stress magnitudes and the stress directions.

As a result, the assumption of increasing closure stress with depth may be verified and intervals of unexpected weakness may be identified to enable computation of a dynamically changing maximum drilling mud weight. The dynamically changing maximum drilling mud weight may eliminate lost circulation events where an increase in drilling mud weight at a deeper depth results in an unexpected hydraulic fracture at a depth between the casing shoe and the drill bit 74. The data may be used to calibrate the log derived closure stress so that a continuous profile of closure stress vs. depth may be obtained.

In a conventional reservoir, the bounding shales provide a stress boundary across which a hydraulic induced fracture is inhibited from crossing due to the shale having a higher closure stress than the reservoir. In wellbores drilled through gas shale reservoirs, the production interval is within the shale intervals which are the source rocks. Gas shale reservoirs require extensive hydraulic fracture programs to create a commercial flow of hydrocarbons. However, the reservoir rocks and the non-reservoir rocks have minimal closure stress contrast between them. An accurate measurement of the actual in situ closure stress of the individual layers may provide a stress profile which may be used to determine the optimal layer or layers in which a hydraulic fracture may be initiated so that the fracture may be contained within the more productive layers having the lower closure stresses.

When a highly deviated well is drilled through the reservoir, the more productive layers may not have been penetrated throughout the entire wellbore. Typically, the entire lateral section is hydraulically fractured in stages at a high cost. Many of these stages contribute minimal hydrocarbon production. A formation closure stress profile may enable the operator to determine if a hydraulic fracture initiated into these sub-optimal layers will propagate up or down into the optimal reservoir layers. If a hydraulic fracture initiated into these sub-optimal layers will not propagate up or down into the optimal reservoir layers, the operator will not attempt to initiate a hydraulic fracture and will avoid the cost and the effort associated with attempting to initiate a hydraulic fracture.

The presence of a downhole packer, such as packer in the BHA 96, may enable the fracture to be initiated between the drill bit 74 and the packer. If a downhole packer is absent or a downhole packer is not deployed, a weaker layer in the open hole section may be identified. As a result, the operator may maintain the mud pressures below values that would create a hydraulic fracture and lost circulation in the open hole interval above the drill bit 74.

Figure 12:
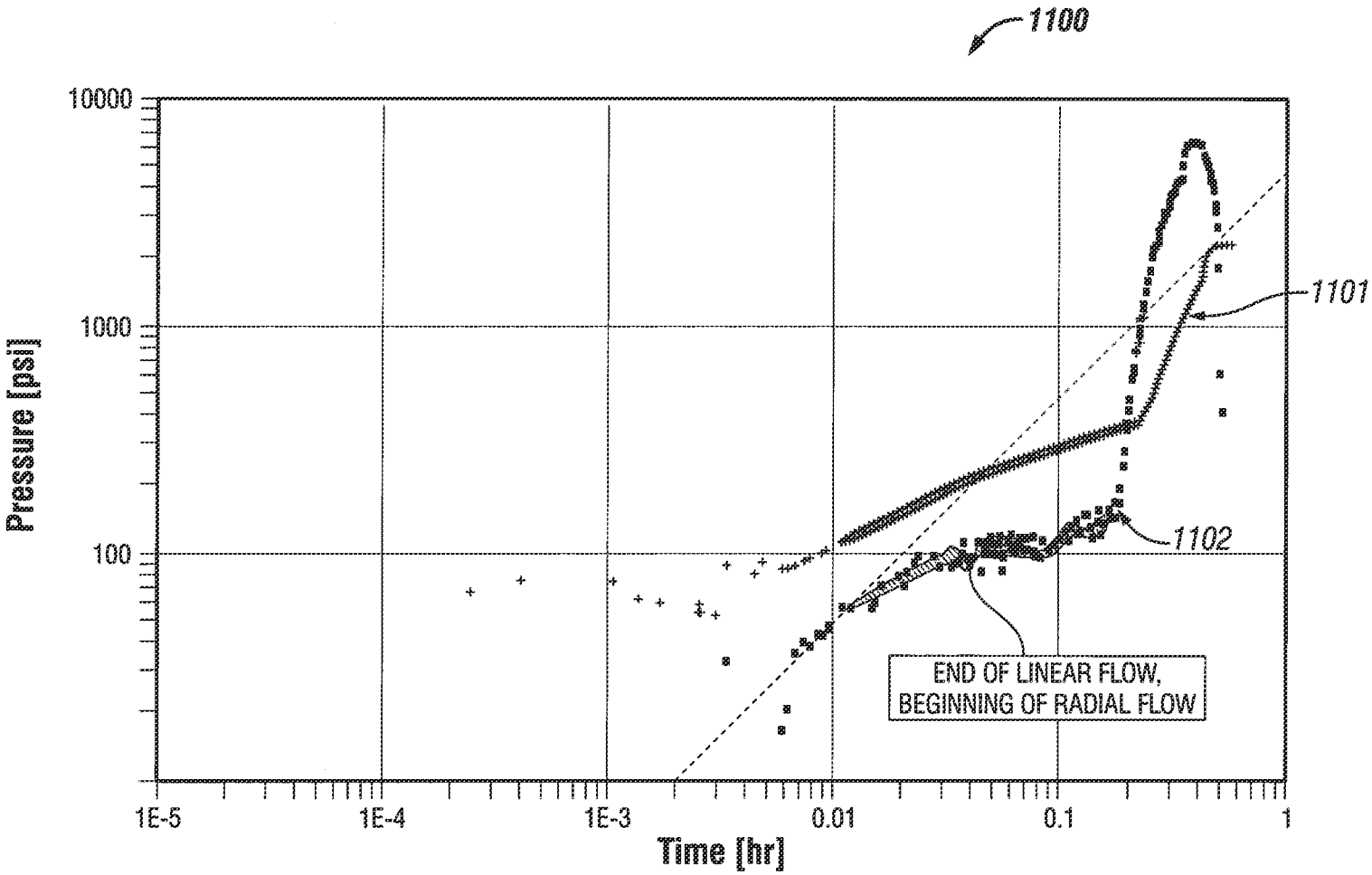

An example of interpretation of a LOT to determine closure stress follows hereafter. FIG. 12 generally illustrates a graph 1100 having a log-log plot 1101 of delta pressure as a function of elapsed time for the fall-off time period of the LOT shown in FIG. 4. The graph 1100 has a plot 1102 of the derivative pressure as a function of elapsed time for the fall-off time period of the LOT shown in FIG. 4. The fall-off data collected after shut-in of the LOT indicates that there are minimal early time wellbore storage effects since the wellbore received the injection and was pressurized during the LOT phase. As the formation receives the drilling mud during the injection phase and then immediately after shut-in, the flow of drilling mud may be transmitted through the induced fracture. The fracture was intentionally created during the LOT to measure the closure stress.

The linear flow regime where the derivative is at 0.5 slope extends to 0.035 hours pseudo time. Radial flow occurs after 0.035 hours pseudo time. The end of the linear flow corresponds to closure of the induced hydraulic fracture. The closure causes the remaining drilling mud to travel through the formation in a radial flow regime. The pressure at which the fracture closes is considered the fracture closure pressure (FCP), and the FCP is equal to the far field horizontal stress in this vertical wellbore. The FCP for the example in FIG. 12 is interpreted to be 2235 psi occurring at 0.035 hours after shut-in. From 0.035 hours to 0.10 hours, the pressure has a zero derivative slope which indicates radial flow. Radial flow is anticipated after the induced hydraulic fracture closes and the injected drilling fluid propagates through the pore structure of the formation.

The data on the log-log plot after 0.18 hours represents wellbore storage effects and is not considered in the interpretation. The FIP for this wellbore was 1621-1815 psi, and the UFP pressure was 2454 psi. The closure stress is between the FIP and the UFP as expected for this wellbore deviation and isotropic stress state.

In summary, an analysis of several data sets demonstrates that the first response after the unity wellbore storage effect is either a bi-linear 0.25 slope or, in most cases, the 0.5 slope linear flow regime. The transition to the radial flow regime with a zero derivative slope marks the FCP and is defined as the closure stress.

Determination of the closure stress may be repeated at one or more different depths in the wellbore 71 to define a closure stress profile. The closure stress profile may be used to predict the orientation, the vertical extent and/or the radial extent of an induced hydraulic fracture. A continuous closure stress profile may be obtained by utilizing the continuous log measurement-derived rock properties/closure stress profile and then calibrating the rock properties/closure stress profile to the discrete closure stresses obtained as previously set forth herein. The continuous closure stress profile may be used to optimize the dimensions of the induced hydraulic fracture as described in more detail hereafter.

Figure 13:
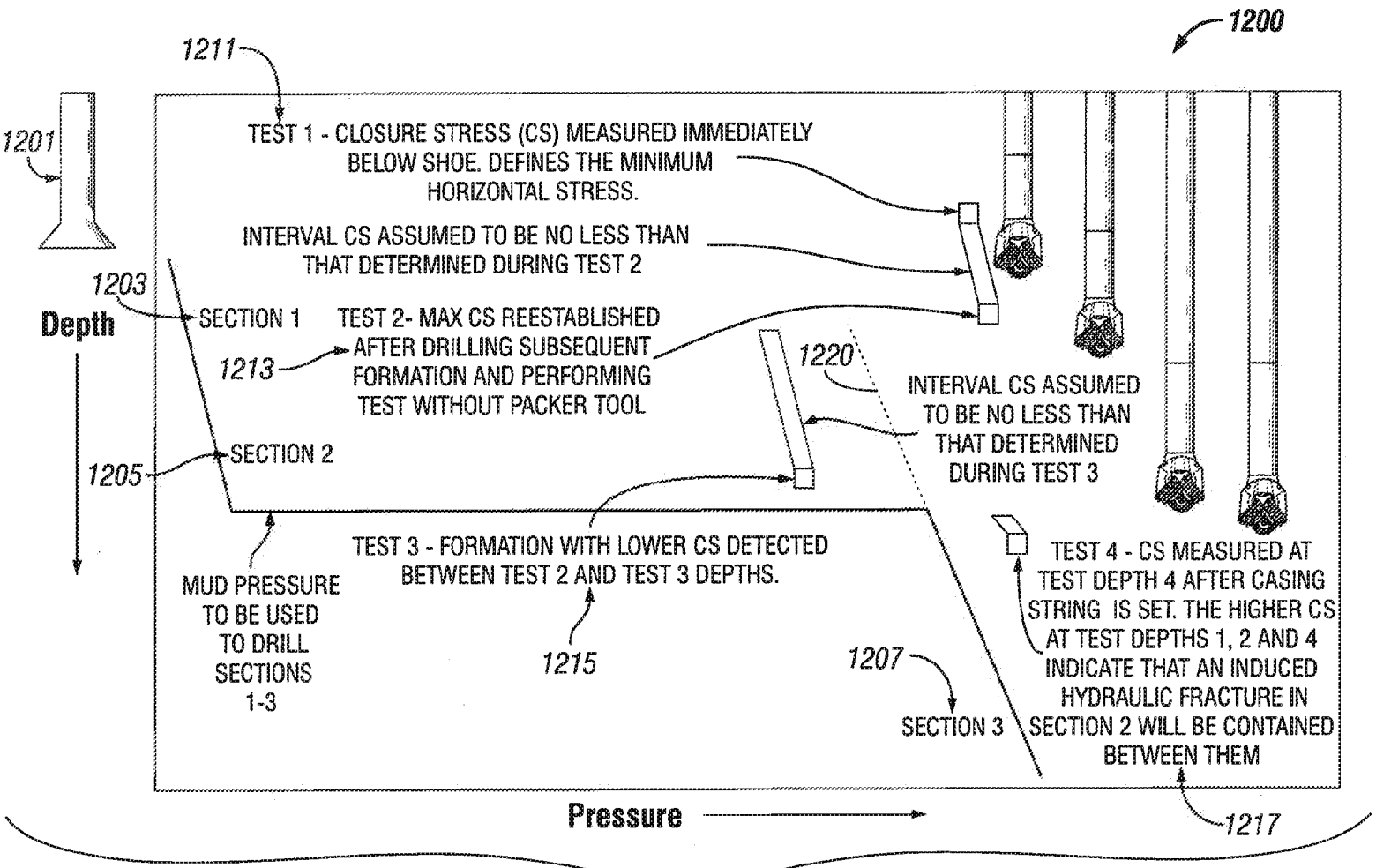

FIG. 13 generally illustrates a method 1200 for obtaining a closure stress profile without a packer tool in the BHA 96 or drill string 72. The method 1200 may test a first section 1203, a second section 1205 and/or a third section 1207 of the wellbore 71. In step 1201, a first FIT/LOT may determine the closure stress immediately below the casing shoe 1201 as previously set forth herein. In step 1203, a second FIT/LOT may be performed, and, in the first section 1203 of the wellbore 71, the wellbore pressure for the second FIT/LOT may be increased until one of the following two events occurs.

One event is the re-opening of the fracture created during the first FIT/LOT. Re-opening of the fracture will occur at a pressure which is less than the CFP and the UFP because the tensile strength of the rock and the near wellbore hoop stresses need not be overcome. In this case, the closure stress determined during the first FIT/LOT may be added to the hydrostatic head between the depth of the first FIT/LOT and the depth of the second FIT/LOT. The closure stress determined in the second FIT/LOT will not be less than the sum of this addition.

The other event is identification of a formation which is located between the depth of the first FIT/LOT and the depth of the second FIT/LOT and has a UFP less than the re-opening fracture pressure of the first FIT/LOT such that a fracture may be created and the closure stress determined for the fracture. Typically the closure stress will be less than or equal to the closure stress in the first FIT/LOT. In this example, the closure stress determined for a third FIT/LOT performed at step 1215 is significantly lower than the closure stresses found in the first FIT/LOT and the second FIT/LOT. The absence of a downhole packer prevents determination of the exact depth level of the weaker formation. However, the entirety of the second section 1203 may be tested.

Based on the drilling mud pressure planned for the third section 1207 of the wellbore 71, the drilling mud pressure represented by the dashed line 1220 at the depth of the third FIT/LOT exceeds the PSP and the CFP pressure for the third section 1207 of the wellbore 71 as determined from the fourth FIT/LOT. Therefore, casing may be set in a strong formation with a high closure stress before drilling the third section 1207.

In the example in FIG. 13, a fourth FIT/LOT may be performed in step 1217 after setting casing in a strong formation with a high closure stress. Even the limited number of closure stresses available in this scenario provides a closure stress profile that may be enhanced using logs and core data. The presence of a permeable sand within the interval tested may result in lost circulation during the test. To measure the closure stress of a new section of the wellbore 71 in the absence of a downhole packer, the fracture re-opening pressure from a shallower test may not be exceeded or, alternatively, a re-test of the shallower interval may be made.

Figure 14:
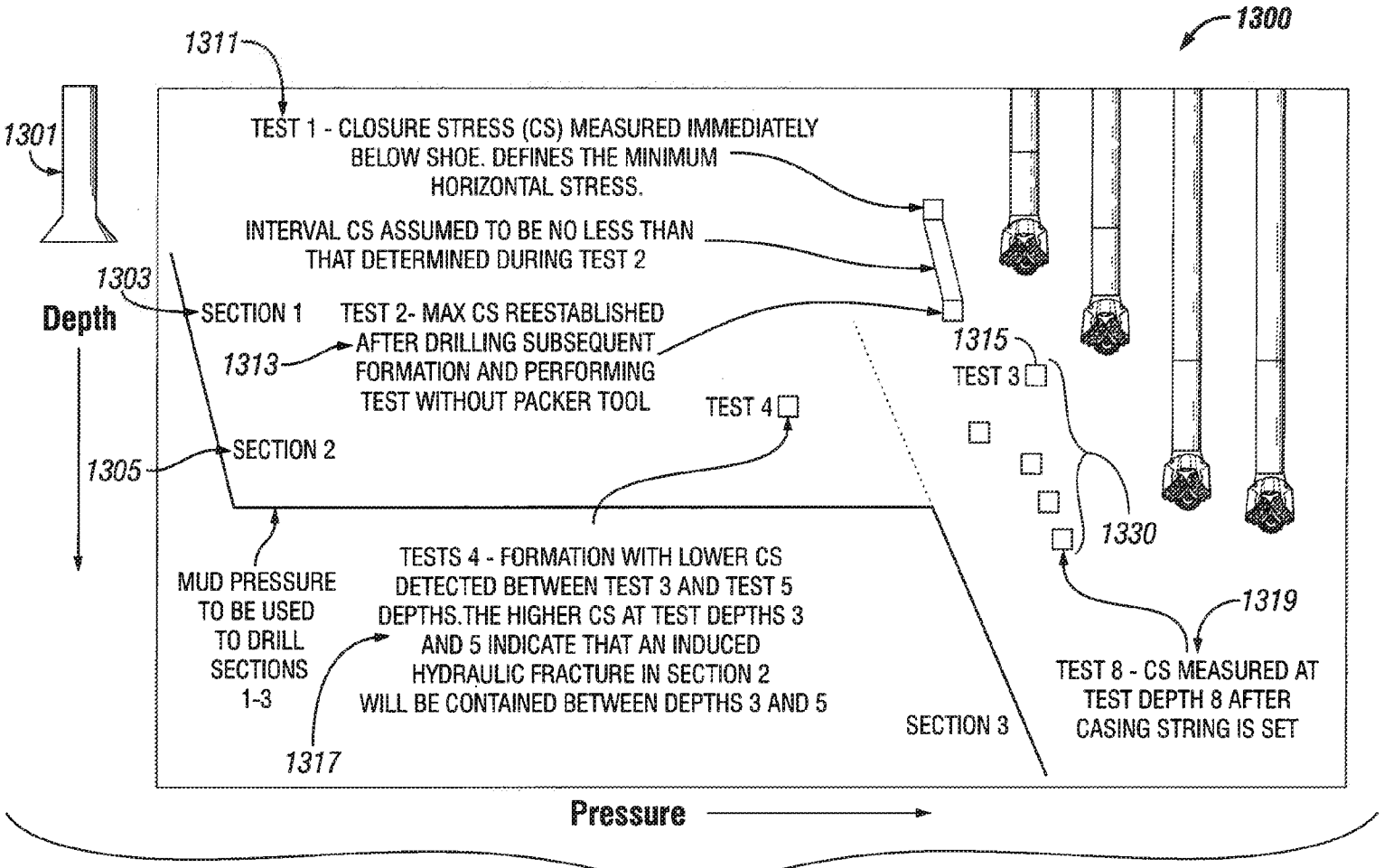

The use of a downhole packer, such as a packer in the drill string 72, may enable specific depth intervals to be isolated for testing. FIG. 14 generally illustrates a method 1300 for obtaining a closure stress profile using a packer tool in the BHA 96 or drill string 72. The method 1300 may test a first section 1303, a second section 1305 and/or a third section 1307 of the wellbore 71. In step 1311, a first FIT/LOT may determine the closure stress immediately below the casing shoe 1301 as previously set forth herein.

At step 1313, a second FIT/LOT may be performed without deploying the packer in the drill string 72. The analysis of the results of the second FIT/LOT may be substantially similar to the analysis described for FIG. 11. At step 1315, a third FIT/LOT may be performed, and the packer may be deployed during the third FIT/LOT. As a result of the isolation of the tested interval of the wellbore 71, the pressure during the third FIT/LOT may be increased above the fracture re-opening pressure determined in the second FIT/LOT. During the third FIT/LOT, the pressure measurements may be analyzed to obtain the closure stress as previously set forth herein. The closure stress may be assigned to the interval exposed at the depth of the third FIT/LOT.

At step 1317, a fourth FIT/LOT may determine that the formation at the tested interval has a lower closure stress than the formations above the tested interval. At step 1319, the fourth FIT/LOT, a fifth FIT/LOT, a sixth FIT/LOT, a seventh FIT/LOT and/or an eighth FIT/LOT may be performed to obtain a detailed closure stress profile with depth. The squares 1330 in FIG. 12 represent the closure stresses of one or more geological layers. To further refine the resolution in depth, continuous measured well logs may be employed. A combination of core and log measurements may be used to create a continuous closure stress profile.

At step 1319, the eighth FIT/LOT may be performed. The eighth FIT/LOT may determine the CFP after the casing string is set above the third section 1307. After the eighth FIT/LOT determines the CFP, the third section 1307 may be drilled.

Figure 15:
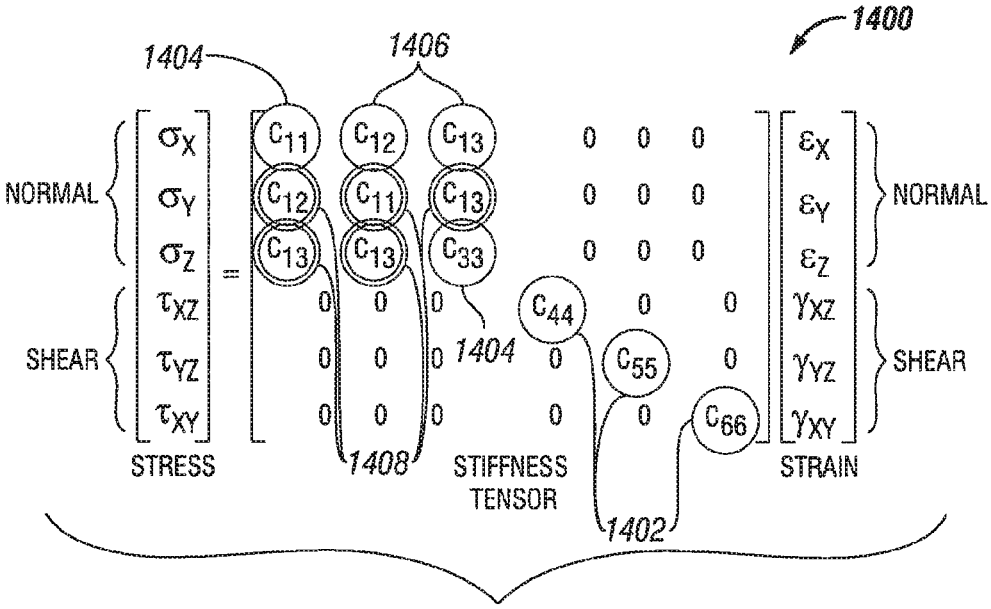
FIG. 15 generally illustrates a matrix representation of Hooke's law for a formation which is transversely isotropic and vertically anisotropic.
Figure 16:
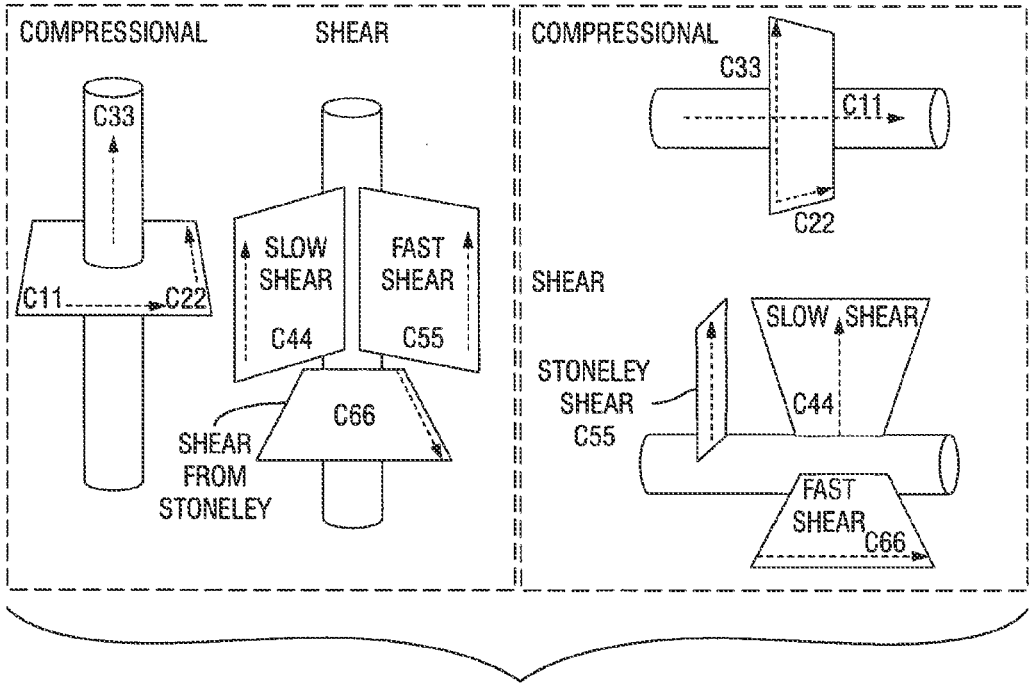
FIG. 16 generally illustrates log measurements and their relationship to the stiffness tensor illustrated in FIG. 15.

FIG. 15 is a matrix representation 1400 of Hooke's law for a formation which is transversely isotropic and a vertically anisotropic (also known as a "TIV medium"), such as a shale interval or a finely layered interval. The matrix representation 1400 shows a tensor relationship between the normal and shear stresses, stiffness, and strain. FIG. 16 generally illustrates log measurements and their relationship to the stiffness tensor illustrated in FIG. 15.

FIG. 15 illustrates the stiffness tensor parameters described in FIG. 16 for a TIV medium where $C_{ij}$=r*Velocity$_{ij}^2$ $C_{11}$=r*compressional wave velocity$^2$ measured in a horizontal well $C_{33}$=r*compressional wave velocity$^2$ measured in a vertical well $C_{44}$=r*slow (in TIV $C_{44}$=$C_{55}$) shear wave velocity$^2$ measured in a vertical well or r*slow shear wave velocity$^2$ measured in a horizontal well $C_{55}$=r*fast (in TIV $C_{44}$=$C_{55}$) shear wave velocity$^2$ measured in a vertical well or the r*stonely derived shear velocity$^2$ in a horizontal well $C_{66}$=r*Stonely derived shear velocity$^2$ in a vertical well or r*fast shear velocity$^2$ in a horizontal well The parameters 1402, 1404, 1406, 1408 in FIG. 15 may be derived from modern dipole or quadrapole source sonic tools having the ability to measure azimuthal shear, compressional, and Stonely derived shear velocities. Parameters 1402 may be measured by logs independent of deviation, parameters 1404 may be measured in a horizontal well or a vertical well, parameters 1406 may be calculated empirically, and parameters 1408 may be determined as set forth hereafter.

In a horizontal well drilled parallel to bedding, $C_{11}$ is measured, while in a vertical well drilled perpendicular to bedding, $C_{33}$ is measured. The stiffness parameters are used to determine the far field closure stress using the following equation.

$$\sigma_h = \left[\frac{C_{13}}{C_{33}}(\sigma_v - \alpha p_p) + \alpha p_p\right] + \frac{\Delta h}{h}\left[\frac{C_{13}}{C_{33}}(\sigma_v - \alpha p_p) + \alpha p_p\right] + \Delta p_p\left(1 - \frac{C_{13}}{C_{33}}\right) + \left(C_{12} - \frac{C_{13}^2}{C_{33}}\right)\varepsilon_H$$

where term 1 represents gravityloading term 2 represents subsidence and uplift term 3 represents changes in pore pressure and term 4 represents tectonic effects $\sigma_h$=farfield closure stress $\epsilon_H$=tectonic stress $\sigma_v$=overburden stress $p_p$=pore pressure $\alpha$=Biotconstant $C_{ij}$=compliance factors The constants $C_{13}$, $C_{12}$ and $C_{33}$ may be the only stiffness parameters needed. $C_{13}$ and $C_{12}$ are not measured directly by a logging tool and may be determined using the log measurement of $C_{33}$ or $C_{11}$, the core-derived constant z and the core-derived constant x in the following empirical relationships.

$$C_{13}=zC_{33}-2C_{55}$$

$$C_{12}=xC_{13}$$

$$C_{11}=2C_{66}+C_{12}$$

In an isotropic medium, $C_{13}$=$C_{33}$−2$C_{55}$, $C_{11}$=$C_{33}$ and the core constants are not needed, regardless of wellbore inclination. For a TIV medium, the constant z when drilled perpendicular to bedding, and the constant z and the constant x at other relative angles, are needed to account for the anisotropy.

In a vertical wellbore exhibiting TIV anisotropy where $C_{33}$, $C_{44}$, $C_{55}$, and $C_{66}$ are measured but $C_{11}$ is not, core measurements are used to measure $C_{13}$, $C_{33}$, and $C_{55}$ for each rock class to determine the constant z. The rock class may be determined using heterogenous rock analysis (HRA) and/or a similar facies/rock class grouping technique. The constant z may be applied by rock class to the log measured $C_{33}$ and $C_{55}$ measurements to compute a continuous $C_{13}$ to use with the measured $C_{33}$ in the above equation for determination of the far field closure stress. In addition, the constant x may be determined by rock class by using core measured values of $C_{12}$ and $C_{13}$. Then, $C_{12}$ and $C_{11}$ may be determined using the second and third empirical relationships, respectively, and the log measurements. $C_{12}$ and $C_{11}$ are not needed for the first empirical relationship; however, constant z and constant x may be recorded for each rock class so that they are available when an operator begins drilling horizontal wells as discussed hereafter.

In a horizontal wellbore where $C_{11}$, $C_{44}$, $C_{55}$, $C_{66}$ are measured but $C_{33}$ is not, the third empirical relationship may be used to determine $C_{12}$. If the constant x was determined from offset vertical wells by rock class, the second empirical relationship may be used to determine $C_{13}$. If not, the core measured $C_{12}$ and $C_{13}$ values may be used to determine the constant x by rock class to apply to the log derived $C_{12}$ values to determine a continuous $C_{13}$ value. Then, the first empirical relationship may be used to determine a continuous $C_{33}$ for use in the above equation for determination of the far field closure stress.

Then, the continuous closure stress profile may be input into a 3D hydraulic fracture simulator to determine the hydraulic fracture characteristics, such as width, radial extent, leakoff, geometric complexity, and the like, for any given fluid and solid injection rates, pressures, and fluid characteristics using existing hydraulic fracture simulators.

Additional uses for the data obtained during the measurement of the pressure build-up and fall-off versus time as previously set forth herein are described hereafter. For example, the closure stress may be measured in the presence of a deployed downhole packer, and the net treating pressure may be measured to indicate how the fracture is propagating, namely crossing or non-crossing. The net treating pressure is the difference between the treating fluid pressure and the net effective stress. How the fracture is propagating may be output as a hydraulic fracture complexity index.

As another example, after the instantaneous shut-in pressure (ISIP), namely the pressure measured immediately after injection stops, the drilling mud may be allowed to "leak-off" into the formation to allow the fracture to close. The pressure at this event may be derived as previously set forth herein. The rate of leak-off is determined by the formation permeability. Therefore, the analysis of the pressure data during the leak-off time period may be used to determine the formation permeability.

As yet another example, the determination of the closure stress requires that the breakdown pressure or UFP be exceeded. The breakdown pressure may or may not correlate to the closure stress. The UFP may have to be overcome during a hydraulic fracture stimulation procedure. Intervals may be fractured to determine a breakdown profile vs. depth and/or to provide hydraulic fracture initiation sites for a subsequent hydraulic fracture stimulation operation. Thus, high breakdown pressure intervals may be avoided or the subsequent breakdown pressures may be reduced to at least the fracture re-opening pressure. If casing and annular cement are positioned in the wellbore after drilling and before the hydraulic fracture stimulation operation, the casing and the annular cement may reduce the effectiveness of these pre-initiation sites unless the perforations are positioned in the same interval and in a similar orientation as the fracture. Alternatively, the pre-initiation fracture sites may be used to create tortuosity or multiple fracture orientation sites for the subsequent hydraulic fracture.

The closure stress calculations may be used to determine the fracture conductivity, the fracture efficiency, and the formation permeability as well as the closure stress. These parameters may be used to define the hydraulic fracture stimulation procedures, such as pump rates, fluid viscosities, proppant rate schedules, which may define the geometry and the width of the created hydraulic fracture. The fracture geometry determines the formation flow rates, propensity to produce sand, and radial extent of the injected proppant.

FIG. 17 is a table summarizing determination of the PSP, the CFP and the closure stress pressure according to one or more aspects of the present disclosure. As a result of one or more aspects of the present disclosure, the FIT/LOT data may be interpreted to obtain the maximum acceptable pressure without creating an uncontrolled hydraulic fracture. Further, this maximum acceptable pressure may be obtained while drilling and circulating drilling mud by manipulating a surface or downhole choke such as in "managed pressure drilling" operations so that this maximum acceptable pressure is attained with or without the need to stop the drilling process. Still further, the closure stress of the formation may be determined after creating a hydraulic fracture during a LOT. Moreover, a series of closure stresses may be used define a closure stress or formation strength profile that may then be used to properly optimize the drilling practices to drill the wellbore without lost circulation events. Casing strings may be run and cemented at the optimum depths, and the hydraulic stimulation program may be properly designed for the well.

More specifically, as a result of one or more aspects of the present disclosure, the controlled fracture pressure (CFP) may be determined and may be used to define the maximum safe mud weight for drilling the subsequent hole section. Further, a FIT/LOT test may be terminated at the CFP point before the UFP point is reached and an unintentional fracture is propagated into the formation. Still further, a weaker formation having a lower CFP and located in the subsequent hole section may be identified, and/or a layer that did have a high CFP but became weaker with time to subsequently have a lower CFP after drilling and being exposed to the mud fluids may be identified. Still further, the closure stress profile with depth may be determined for drilling and hydraulic fracturing applications. Moreover, these determinations and/or identifications may be performed with or without a packer in the BHA 96 and with or without deploying the packer.

According to one or more aspects of the present disclosure, the CFP may be determined from measured pressure, time and flow data. Further, the closure stress may be determined from measured pressure, time and flow data. Still further, a continuous CS profile may be generated using measured closure stress values, log, and core measurements. Moreover, unexpected influx while drilling may be controlled by inflating downhole packer and circulating sufficiently heavy mud through diverter valves to balance measured pressure below the packer.

Although exemplary systems and methods are described in language specific to structural features and/or methodological acts, the subject matter defined in the appended claims is not necessarily limited to the specific features or acts described. Rather, the specific features and acts are disclosed as exemplary forms of implementing the claimed systems, methods, and structures.

What is claimed is:

1. A method for performing a test in a wellbore in which a drill string having a bottom-hole assembly and a drill bit is located, comprising:

increasing a pressure of a drilling mud located in the wellbore;

obtaining downhole measurements using downhole sensors wherein the downhole measurements indicate the pressure of the drilling mud and a flow rate of the drilling mud;

determining and monitoring a slope of a pressure derivative wherein the pressure derivative is the derivative of the pressure with respect to a natural log of a time value wherein the time value is based on time elapsed after increasing the pressure of the drilling mud and is based on the flow rate of the drilling mud; and terminating the test after determination that predetermined criteria regarding the slope of the pressure derivative are fulfilled.

2. The method of claim 1, further comprising:

detecting unity slope for the pressure derivative wherein the predetermined criteria includes detection of the unity slope for the pressure derivative.

3. The method of claim 1, further comprising:

detecting 0.25 slope and 0.5 slope for the pressure derivative wherein the predetermined criteria includes detection of the 0.25 slope and the 0.5 slope for the pressure derivative.

4. The method of claim 1, further comprising:

detecting zero slope of the pressure derivative for a predetermined time period and then detecting that a change in pressure deviates from the unity slope by a predetermined value wherein the predetermined criteria includes detection of the zero slope of the pressure derivative for the predetermined time period and further wherein the test is terminated after detection of the change in pressure deviating from the unity slope by the predetermined value and determination that the predetermined criteria regarding the slope of the pressure derivative are fulfilled.

5. The method of claim 4, further comprising:

determining the predetermined value based on accuracy of the downhole sensors.

6. The method of claim 1, further comprising:

detecting that the pressure derivative decreased by a predetermined value from the pressure derivative during zero slope of the pressure derivative wherein the predetermined criteria includes detection of the pressure derivative decreasing by the predetermined value from the pressure derivative during the zero slope of the pressure derivative.

7. The method of claim 1, further comprising:

deploying a downhole packer before pressurizing the drilling mud.

8. The method of claim 1, further comprising:

pressurizing the drilling mud without deploying a downhole packer.

9. The method of claim 8, further comprising:

using the pressure derivative to identify a section of the wellbore having a formation strength which decreased relative to a previous leak off test.

10. The method of claim 1, further comprising:

drilling the wellbore while increasing the pressure of the drilling mud located in the wellbore and obtaining the downhole measurements using the downhole sensors.

11. The method of claim 1, further comprising:

using a surface choke coupled with an annular preventer to increase the pressure of the drilling mud.

12. A method for performing a test in a wellbore in which a drill string having a bottom-hole assembly and a drill bit is located, comprising:

increasing a pressure of drilling mud located in the wellbore;

obtaining downhole measurements using downhole sensors wherein the downhole measurements indicate the pressure of the drilling mud and a flow rate of the drilling mud;

inducing fractures in at least one formation at a plurality of depths while increasing the pressure of the drilling mud and obtaining the pressure measurements;

determining and monitoring a slope of a pressure derivative at each of the plurality of depths wherein the pressure derivative is the derivative of the pressure with respect to the natural log of a time value wherein the time value is based on time elapsed after increasing the pressure of the drilling mud;

detecting zero slope of the pressure derivative after the pressure derivative attains one or more predetermined slopes wherein a closure stress of the formation at each of the plurality of depths is the pressure of the drilling mud when the pressure derivative is the zero slope after the pressure derivative attains the one or more predetermined slopes; and generating a closure stress profile based on the closure stress at each of the plurality of depths.

13. The method of claim 12, wherein the predetermined slopes are unity slope, 0.25 slope and 0.5 slope.

14. The method of claim 12, further comprising:

generating a continuous closure stress profile by calibrating a continuous log measurement-derived stress profile with the closure stress at each of the plurality of depths.

15. The method of claim 12, further comprising:

deploying a downhole packer to control an influx of the drilling mud detected during drilling wherein the pressure measurements obtained below the packer indicate the pressure of the drilling mud necessary to stop the influx.

16. The method of claim 12, further comprising:

measuring the closure stress using a deployed downhole packer wherein a net treating pressure is measured to indicate how the fracture is propagating wherein the net treating pressure is the difference between a treating fluid pressure and a net effective stress.

17. The method of claim 12, further comprising:

determining a breakdown profile as a function of depth using the downhole measurements.

18. A method for performing a test in a wellbore in which a drill string having a bottom-hole assembly and a drill bit is located, comprising:

increasing a pressure of drilling mud located in the wellbore;

obtaining downhole measurements using downhole sensors wherein the downhole measurements indicate the pressure of the drilling mud and a flow rate of the drilling mud;

determining and monitoring a slope of a pressure derivative wherein the pressure derivative is a derivative of the pressure with respect to a natural log of a time value wherein the time value is based on time elapsed after increasing the pressure of the drilling mud and is based on the flow rate of the drilling mud;

identifying the pressure derivative during a zero slope of the pressure derivative;

determining a controlled fracture pressure which is the pressure of the drilling mud when the pressure derivative decreases by a decade from the pressure derivative identified during the zero slope of the pressure derivative; and terminating the test after identifying the controlled fracture pressure.

19. The method of claim 18, further comprising:

using the controlled fracture pressure to drill a subsequent section of the wellbore.

20. The method of claim 19, further comprising:

identifying the pressure derivative during the zero slope after determining that the pressure derivative attains a plurality of predetermined slope values.

* * * * *